US010033122B2

(12) United States Patent
Burris et al.

(10) Patent No.: US 10,033,122 B2
(45) Date of Patent: Jul. 24, 2018

(54) CABLE OR CONDUIT CONNECTOR WITH JACKET RETENTION FEATURE

(71) Applicant: Corning Optical Communications RF LLC, Glendale, AZ (US)

(72) Inventors: Donald Andrew Burris, Peoria, AZ (US); Thomas Dewey Miller, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 14/797,575

(22) Filed: Jul. 13, 2015

(65) Prior Publication Data

US 2016/0248179 A1 Aug. 25, 2016

Related U.S. Application Data

(60) Provisional application No. 62/118,598, filed on Feb. 20, 2015.

(51) Int. Cl.
*H01R 9/05* (2006.01)
*H01R 43/16* (2006.01)
*H01R 13/59* (2006.01)

(52) U.S. Cl.
CPC ..... *H01R 9/0521* (2013.01); *H01R 9/0524* (2013.01); *H01R 13/59* (2013.01); *H01R 43/16* (2013.01)

(58) Field of Classification Search
CPC ... H01R 13/59; H01R 9/0518; H01R 13/0524
USPC ..... 439/583, 584, 585
See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |

(Continued)

FOREIGN PATENT DOCUMENTS

| | | |
|---|---|---|
| CA | 2096710 | 11/1994 |
| CN | 1210379 | 3/1999 |

(Continued)

OTHER PUBLICATIONS

European Search Report dated Apr. 8, 2015 pertaining to European Patent Application No. 13733586.5.

(Continued)

*Primary Examiner* — Tulsidas C Patel
*Assistant Examiner* — Marcus Harcum

(57) ABSTRACT

Connectors and methods for attaching connectors to one or more cables and/or conduits are disclosed. The disclosed connectors and methods may secure an outer surface of the cable (e.g., an outer jacket of a cable) or conduit. A front coupler sleeve engages a sub-assembly comprising a back coupler sleeve and an actuator sleeve disposed around the cable or conduit. During engagement of an inner surface of the front coupler sleeve and an outer surface of the back coupler sleeve, an at least partially annular protrusion of the back coupler sleeve is displaced radially inwardly to secure the outer surface of the cable or conduit.

18 Claims, 19 Drawing Sheets

(56) References Cited

U.S. PATENT DOCUMENTS 1,667,485 A 4/1928 MacDonald
1,766,869 A 6/1930 Austin
1,801,999 A 4/1931 Bowman
1,885,761 A 11/1932 Peirce, Jr.
1,959,302 A 5/1934 Paige
2,013,526 A 9/1935 Schmitt
2,059,920 A 11/1936 Weatherhead, Jr.
2,102,495 A 12/1937 England
2,258,528 A 10/1941 Wurzburger
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,705,652 A 4/1955 Kaiser
2,743,505 A 5/1956 Hill
2,754,487 A 7/1956 Carr et al.
2,755,331 A 7/1956 Melcher
2,757,351 A 7/1956 Klostermann
2,762,025 A 9/1956 Melcher
2,785,384 A 3/1957 Wickesser
2,805,399 A 9/1957 Leeper
2,816,949 A 12/1957 Curtiss
2,870,420 A 1/1959 Malek
2,878,039 A 3/1959 Hoegee et al.
2,881,406 A 4/1959 Arson
2,963,536 A 12/1960 Kokalas
3,001,169 A 9/1961 Blonder
3,015,794 A 1/1962 Kishbaugh
3,051,925 A 8/1962 Felts
3,091,748 A 5/1963 Takes et al.
3,094,364 A 6/1963 Lingg
3,103,548 A 9/1963 Concelman
3,106,548 A 10/1963 Lavalou
3,140,106 A 7/1964 Thomas et al.
3,161,451 A 12/1964 Neidecker
3,184,706 A 5/1965 Atkins
3,193,309 A 7/1965 Morris
3,194,292 A 7/1965 Borowsky
3,196,382 A 7/1965 Morello, Jr.
3,206,540 A 9/1965 Cohen
3,245,027 A 4/1966 Ziegler, Jr.
3,275,913 A 9/1966 Blanchard et al.
3,278,890 A 10/1966 Cooney
3,281,756 A 10/1966 O'Keefe et al.
3,281,757 A 10/1966 Bonhomme
3,290,069 A 12/1966 Davis
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,667 A 10/1967 Shreve
3,350,677 A 10/1967 Daum
3,355,698 A 11/1967 Keller
3,372,364 A 3/1968 O'Keefe et al.
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,499,671 A 3/1970 Osborne
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,596,933 A 8/1971 Luckenbill
3,601,776 A 8/1971 Curl
3,603,912 A 9/1971 Kelly
3,614,711 A 10/1971 Anderson et al.
3,622,952 A 11/1971 Hilbert
3,629,792 A 12/1971 Dorrell
3,633,150 A 1/1972 Schwartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,671,926 A 6/1972 Nepovim
3,678,444 A 7/1972 Stevens et al.
3,678,445 A 7/1972 Brancaloene
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,694,793 A 9/1972 Concelman
3,697,930 A 10/1972 Shirey
3,706,958 A 12/1972 Blanchenot
3,708,186 A 1/1973 Takagi et al.
3,710,005 A 1/1973 French
3,739,076 A 6/1973 Schwartz
3,744,007 A 7/1973 Horak
3,744,011 A 7/1973 Blanchenot
3,761,870 A 9/1973 Drezin et al.
3,778,535 A 12/1973 Forney, Jr.
3,781,762 A 12/1973 Quackenbush
3,781,898 A 12/1973 Holloway
3,783,178 A 1/1974 Philibert et al.
3,787,796 A 1/1974 Barr
3,793,610 A 2/1974 Brishka
3,798,589 A 3/1974 Deardurff
3,808,580 A 4/1974 Johnson
3,810,076 A 5/1974 Hutter
3,824,026 A 7/1974 Gaskins
3,835,443 A 9/1974 Arnold et al.
3,836,700 A 9/1974 Niemeyer
3,845,453 A 10/1974 Hemmer
3,846,738 A 11/1974 Nepovim
3,847,463 A 11/1974 Hayward et al.
3,854,003 A 12/1974 Duret
3,854,789 A 12/1974 Kaplan
3,858,156 A 12/1974 Zarro
3,879,102 A 4/1975 Horak
3,886,301 A 5/1975 Cronin et al.
3,907,335 A 9/1975 Burge et al.
3,907,399 A 9/1975 Spinner
3,910,673 A 10/1975 Stokes
3,915,539 A 10/1975 Collins
3,936,132 A 2/1976 Hutter
3,937,547 A 2/1976 Lee-Kemp
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al.
4,012,105 A 3/1977 Biddle
4,017,139 A 4/1977 Nelson
4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.
4,046,451 A 9/1977 Juds et al.
4,053,200 A 10/1977 Pugner
4,056,043 A 11/1977 Sriramamurty et al.
4,059,330 A 11/1977 Shirey

(56) References Cited

U.S. PATENT DOCUMENTS 4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,118,097 A 10/1978 Budnick
4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,169,646 A 10/1979 Stape et al.
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,197,628 A 4/1980 Conti et al.
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,239,318 A 12/1980 Schwartz
4,250,348 A 2/1981 Kitagawa
4,260,212 A 4/1981 Ritchie
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,768 A 4/1982 Punako
4,326,769 A 4/1982 Dorsey et al.
4,334,730 A 6/1982 Colwell et al.
4,339,166 A 7/1982 Dayton
4,345,375 A 8/1982 Hayward
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,428,639 A 1/1984 Hillis
4,444,453 A 4/1984 Kirby et al.
4,447,107 A 5/1984 Major et al.
4,452,503 A 6/1984 Forney, Jr.
4,453,200 A 6/1984 Trcka et al.
4,456,323 A 6/1984 Pitcher et al.
4,459,881 A 7/1984 Hughes, Jr.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,491,685 A 1/1985 Drew et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,553,877 A 11/1985 Edvardsen
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,623,205 A 11/1986 Barron
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,666,231 A 5/1987 Sheesley et al.
4,668,043 A 5/1987 Saba et al.
4,670,574 A 6/1987 Malcolm
4,673,236 A 6/1987 Musolff et al.
4,674,809 A 6/1987 Hollyday et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gullusser et al.
4,703,988 A 11/1987 Raux et al.
4,713,021 A 12/1987 Kobler
4,717,355 A 1/1988 Mattis
4,720,155 A 1/1988 Schildkraut et al.
4,728,301 A 3/1988 Hemmer et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,009 A 4/1988 Down et al.
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,274 A 7/1988 Bowers
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman

(56) References Cited

U.S. PATENT DOCUMENTS 4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,963,105 A 10/1990 Lewis et al.
4,964,805 A 10/1990 Gabany
4,964,812 A 10/1990 Siemon et al.
4,973,265 A 11/1990 Heeren
4,976,632 A 12/1990 Riches
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gayer, Jr. et al.
5,067,912 A 11/1991 Bickford et al.
5,073,129 A 12/1991 Szegda
5,074,809 A 12/1991 Rousseau et al.
5,080,600 A 1/1992 Baker et al.
5,083,943 A 1/1992 Tarrant
5,088,937 A 2/1992 Gabany
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,139,440 A 8/1992 Volk et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,176,530 A 1/1993 Reylek
5,176,533 A 1/1993 Sakurai et al.
5,181,161 A 1/1993 Hirose et al.
5,183,417 A 2/1993 Bools
5,185,655 A 2/1993 Glenday et al.
5,186,501 A 2/1993 Mano
5,186,655 A 2/1993 Glenday et al.
5,195,904 A 3/1993 Cyvoct
5,195,905 A 3/1993 Pesci
5,195,906 A 3/1993 Szegda
5,205,547 A 4/1993 Mattingly
5,205,761 A 4/1993 Nilsson
D335,487 S 5/1993 Volk et al.
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,263,880 A 11/1993 Schwarz et al.
5,269,701 A 12/1993 Leibfried, Jr.
5,281,762 A 1/1994 Long et al.
5,283,417 A 2/1994 Misawa et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Sheilds
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,352,134 A 10/1994 Jacobsen et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,475,921 A 12/1995 Johnston
5,488,268 A 1/1996 Bauer et al.
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,511,305 A 4/1996 Garner
5,516,303 A 5/1996 Yohn et al.
5,525,076 A 6/1996 Down
5,542,861 A 8/1996 Anhalt et al.
5,548,088 A 8/1996 Gray et al.

(56) References Cited

U.S. PATENT DOCUMENTS 5,550,521 A 8/1996 Bernaud et al.
5,564,938 A 10/1996 Shenkal et al.
5,566,173 A 10/1996 Steinbrecher
5,571,028 A 11/1996 Szegda
5,571,029 A 11/1996 Poissant et al.
5,586,910 A 12/1996 Del Negro et al.
5,595,499 A 1/1997 Zander et al.
5,598,132 A 1/1997 Stabile
5,607,320 A 3/1997 Wright
5,607,325 A 3/1997 Toma
5,609,501 A 3/1997 McMills et al.
5,620,339 A 4/1997 Gray et al.
5,632,637 A 5/1997 Diener
5,632,651 A 5/1997 Szegda
5,644,104 A 7/1997 Porter et al.
5,649,723 A 7/1997 Larsson
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,759,618 A 6/1998 Taylor
5,761,053 A 6/1998 King et al.
5,769,652 A 6/1998 Wider
5,769,662 A 6/1998 Stabile et al.
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,874,603 A 2/1999 Arkles
5,877,452 A 3/1999 McConnell
5,879,191 A 3/1999 Burris
5,882,226 A 3/1999 Bell et al.
5,890,924 A 4/1999 Endo
5,897,795 A 4/1999 Lu et al.
5,906,511 A 5/1999 Bozzer et al.
5,917,153 A 6/1999 Geroldinger
5,921,793 A 7/1999 Phillips
5,929,383 A * 7/1999 Marik ..... H01R 13/648 174/78
5,938,465 A 8/1999 Fox, Sr.
5,944,548 A 8/1999 Saito
5,951,327 A 9/1999 Marik
5,954,708 A 9/1999 Lopez et al.
5,957,716 A 9/1999 Buckley et al.
5,967,852 A 10/1999 Follingstad et al.
5,975,479 A 11/1999 Suter
5,975,591 A 11/1999 Guest
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,036,540 A 3/2000 Beloritsky
6,042,422 A 3/2000 Youtsey
6,042,429 A 3/2000 Bianca et al.
6,048,229 A 4/2000 Lazaro, Jr.
6,053,743 A 4/2000 Mitchell et al.
6,053,769 A 4/2000 Kubota et al.
6,053,777 A 4/2000 Boyle
6,062,607 A 5/2000 Barthlomew
6,080,015 A 6/2000 Andreescu
6,083,030 A 7/2000 Wright
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,093,043 A 7/2000 Gray et al.
6,095,828 A 8/2000 Burland
6,095,841 A 8/2000 Felps
6,123,550 A 9/2000 Burkert et al.
6,123,567 A 9/2000 McCarthy
6,126,487 A 10/2000 Rosenberger et al.
6,132,234 A 10/2000 Waidner et al.
6,142,812 A 11/2000 Hwang
6,146,197 A 11/2000 Holliday et al.
6,152,752 A 11/2000 Fukuda
6,152,753 A 11/2000 Johnson et al.
6,153,830 A 11/2000 Montena
6,158,298 A 12/2000 Hara
6,162,995 A 12/2000 Bachle et al.
6,164,977 A 12/2000 Lester
6,174,206 B1 1/2001 Yentile et al.
6,183,298 B1 2/2001 Henningsen
6,199,913 B1 3/2001 Wang
6,199,920 B1 3/2001 Neustadtl
6,210,216 B1 4/2001 Tso-Chin et al.
6,210,219 B1 4/2001 Zhu et al.
6,210,222 B1 4/2001 Langham et al.
6,217,383 B1 4/2001 Holland et al.
6,238,240 B1 5/2001 Yu
6,239,359 B1 5/2001 Lilienthal, II et al.
6,241,553 B1 6/2001 Hsia
6,250,942 B1 6/2001 Lemke et al.
6,250,974 B1 6/2001 Kerek
6,257,923 B1 7/2001 Stone et al.
6,261,126 B1 7/2001 Stirling
6,267,612 B1 7/2001 Areykiewicz et al.
6,271,464 B1 8/2001 Cunningham
6,299,475 B1 10/2001 Huspeni et al.
6,331,123 B1 * 12/2001 Rodrigues ..... H01R 9/0524 439/584
6,332,815 B1 12/2001 Bruce
6,352,448 B1 3/2002 Holliday et al.
6,358,077 B1 3/2002 Young
6,361,348 B1 3/2002 Hall et al.
6,361,364 B1 3/2002 Holland et al.
6,375,509 B2 4/2002 Mountford
6,379,183 B1 4/2002 Ayres et al.
6,394,840 B1 5/2002 Gassauer et al.
6,396,367 B1 5/2002 Rosenberger
D458,904 S 6/2002 Montena
6,398,571 B1 6/2002 Nishide et al.
6,406,330 B2 6/2002 Bruce
6,409,534 B1 6/2002 Weisz-Margulescu
D460,739 S 7/2002 Fox
D460,740 S 7/2002 Montena
D460,946 S 7/2002 Montena
D460,947 S 7/2002 Montena
D460,948 S 7/2002 Montena
6,422,884 B1 7/2002 Babasick et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,443,763 B1 9/2002 Richet
6,450,829 B1 9/2002 Weisz-Margulescu
6,454,463 B1 9/2002 Halbach
6,464,526 B1 10/2002 Seufert et al.
6,464,527 B2 10/2002 Volpe et al.
6,467,816 B1 10/2002 Huang
6,468,100 B1 10/2002 Meyer et al.
6,468,103 B1 10/2002 Brower
6,491,546 B1 12/2002 Perry
D468,696 S 1/2003 Montena
6,506,083 B1 1/2003 Bickford et al.

(56) References Cited

U.S. PATENT DOCUMENTS 6,510,610 B2 1/2003 Losinger
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,632,104 B2 10/2003 Quadir
6,634,906 B1 10/2003 Yeh
6,637,101 B2 10/2003 Hathaway et al.
6,645,011 B2 11/2003 Schneider et al.
6,663,397 B1 12/2003 Lin et al.
6,676,446 B2 1/2004 Montena
6,683,253 B1 1/2004 Lee
6,683,773 B2 1/2004 Montena
6,692,285 B2 2/2004 Islam
6,692,286 B1 2/2004 De Cet
6,695,636 B2 2/2004 Hall et al.
6,705,875 B2 3/2004 Berghorn et al.
6,705,884 B1 3/2004 McCarthy
6,709,280 B1 3/2004 Gretz
6,709,289 B2 3/2004 Huber et al.
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,743,040 B1 6/2004 Nakamura
6,749,454 B2 6/2004 Schmidt et al.
6,751,081 B1 6/2004 Kooiman
6,752,633 B2 6/2004 Aizawa et al.
6,761,571 B2 7/2004 Hida
6,767,248 B1 7/2004 Hung
6,769,926 B1 8/2004 Montena
6,780,029 B1 8/2004 Gretz
6,780,042 B1 8/2004 Badescu et al.
6,780,052 B2 8/2004 Montena et al.
6,780,068 B2 8/2004 Bartholoma et al.
6,783,394 B1 8/2004 Holliday
6,690,081 B2 9/2004 Burris et al.
6,786,767 B1 9/2004 Fuks et al.
6,790,081 B2 9/2004 Burris et al.
6,793,528 B2 9/2004 Lin et al.
6,796,847 B2 9/2004 AbuGhazaleh
6,802,738 B1 10/2004 Henningsen
6,805,581 B2 10/2004 Chen
6,805,583 B2 10/2004 Holliday et al.
6,805,584 B1 10/2004 Chen
6,808,415 B1 10/2004 Montena
6,817,272 B2 11/2004 Holland
6,817,896 B2 11/2004 Derenthal
6,817,897 B2 11/2004 Chee
6,827,608 B2 12/2004 Hall et al.
6,830,479 B2 12/2004 Holliday
6,848,115 B2 1/2005 Sugiura et al.
6,848,939 B2 2/2005 Stirling
6,848,940 B2 2/2005 Montena
6,848,941 B2 2/2005 Wlos et al.
6,884,113 B1 4/2005 Montena
6,884,115 B2 4/2005 Malloy
6,887,102 B1 5/2005 Burris et al.
6,916,200 B2 7/2005 Burris et al.
6,929,265 B2 8/2005 Holland et al.
6,929,508 B1 8/2005 Holland
6,935,866 B2 8/2005 Kerekes et al.
6,939,169 B2 9/2005 Islam et al.
6,942,516 B2 9/2005 Shimoyama et al.
6,942,520 B2 9/2005 Barlian et al.
6,944,005 B2 9/2005 Kooiman
6,945,805 B1 9/2005 Bollinger
6,948,976 B2 9/2005 Goodwin et al.
6,953,371 B2 10/2005 Baker et al.
6,955,563 B1 10/2005 Croan
D511,497 S 11/2005 Murphy et al.
D512,024 S 11/2005 Murphy et al.
D512,689 S 12/2005 Murphy et al.
6,971,912 B2 12/2005 Montena et al.
6,979,234 B2 12/2005 Bleicher
7,008,263 B2 3/2006 Holland
7,018,216 B1 3/2006 Clark et al.
7,018,235 B1 3/2006 Burris et al.
7,029,326 B2 4/2006 Montena
D521,454 S 5/2006 Murphy et al.
7,062,851 B2 * 6/2006 Koessler ..... H02G 15/013 174/77 R
7,063,565 B2 6/2006 Ward
7,070,447 B1 7/2006 Montena
7,077,697 B2 7/2006 Kooiman
7,077,699 B2 7/2006 Islam et al.
7,086,897 B2 8/2006 Montena
7,090,525 B1 8/2006 Morana
7,094,114 B2 8/2006 Kurimoto
7,097,499 B1 8/2006 Purdy
7,102,868 B2 9/2006 Montena
7,108,547 B2 9/2006 Kisling et al.
7,108,548 B2 9/2006 Burris et al.
7,112,078 B2 9/2006 Czikora
7,112,093 B1 9/2006 Holland
7,114,990 B2 10/2006 Bence et al.
7,118,285 B2 10/2006 Fenwick et al.
7,118,382 B2 10/2006 Kerekes et al.
7,118,416 B2 10/2006 Montena et al.
7,125,283 B1 10/2006 Lin
7,128,603 B2 10/2006 Burris et al.
7,128,604 B2 10/2006 Hall
7,131,867 B1 11/2006 Foster et al.
7,131,868 B2 11/2006 Montena
7,140,645 B2 11/2006 Cronley
7,144,271 B1 12/2006 Burris et al.
7,144,272 B1 12/2006 Burris et al.
7,147,509 B1 12/2006 Burris et al.
7,153,159 B2 12/2006 Burris et al.
7,156,696 B1 1/2007 Montena
7,161,785 B2 1/2007 Chawgo
7,165,974 B2 1/2007 Kooiman
7,168,992 B2 1/2007 Vo et al.
7,173,121 B2 2/2007 Fang
7,179,121 B1 2/2007 Burris et al.
7,179,122 B2 2/2007 Holliday
7,182,639 B2 2/2007 Burris
7,183,639 B2 2/2007 Mihara et al.
7,189,097 B2 3/2007 Benham
7,189,114 B1 3/2007 Burris et al.
7,192,308 B2 3/2007 Rodrigues et al.
7,229,303 B2 6/2007 Vermoesen et al.
7,238,047 B2 7/2007 Saetele et al.
7,252,536 B2 8/2007 Lazaro, Jr. et al.
7,252,546 B1 8/2007 Holland
7,255,598 B2 8/2007 Montena et al.
7,261,594 B2 8/2007 Kodama et al.
7,264,502 B2 9/2007 Holland
7,278,882 B1 10/2007 Li
7,288,002 B2 10/2007 Rodrigues et al.
7,229,550 B2 11/2007 Montena
7,291,033 B2 11/2007 Hu
7,297,023 B2 11/2007 Chawgo
7,299,550 B2 11/2007 Montena
7,303,435 B2 12/2007 Burris et al.
7,311,555 B1 12/2007 Burris et al.
7,318,609 B2 1/2008 Naito et al.
7,322,846 B2 1/2008 Camelio
7,322,851 B2 1/2008 Brookmire
7,329,139 B2 2/2008 Benham
7,331,820 B2 2/2008 Burris et al.
7,335,058 B1 2/2008 Burris et al.
7,347,129 B1 3/2008 Youtsey
7,347,726 B2 3/2008 Wlos
7,347,727 B2 3/2008 Wlos et al.
7,347,729 B2 3/2008 Thomas et al.
7,351,088 B1 4/2008 Qu
7,357,641 B2 4/2008 Kerekes et al.
7,364,462 B2 4/2008 Holland
7,371,112 B2 5/2008 Burris et al.

(56) References Cited

U.S. PATENT DOCUMENTS 7,371,113 B2 5/2008 Burris et al.
7,375,533 B2 5/2008 Gale
7,387,524 B2 6/2008 Cheng
7,393,245 B2 7/2008 Palinkas et al.
7,396,249 B2 7/2008 Kauffman
7,404,737 B1 7/2008 Youtsey
7,410,389 B2 8/2008 Holliday
7,416,415 B2 8/2008 Hart et al.
7,438,327 B2 10/2008 Auray et al.
7,452,239 B2 11/2008 Montena
7,455,550 B1 11/2008 Sykes
7,458,850 B1 12/2008 Burris et al.
7,458,851 B2 12/2008 Montena
7,462,068 B2 12/2008 Amidon
7,467,980 B2 12/2008 Chiu
7,476,127 B1 1/2009 Wei
7,478,475 B2 1/2009 Hall
7,479,033 B1 1/2009 Sykes et al.
7,479,035 B2 1/2009 Bence et al.
7,484,988 B2 2/2009 Ma et al.
7,484,997 B2 2/2009 Hofling
7,488,210 B1 2/2009 Burris et al.
7,494,355 B2 2/2009 Hughes et al.
7,497,729 B1 3/2009 Wei
7,500,868 B2 3/2009 Holland et al.
7,500,873 B1 3/2009 Hart
7,507,116 B2 3/2009 Laerke et al.
7,507,117 B2 3/2009 Amidon
7,513,788 B2 4/2009 Camelio
7,513,795 B1 4/2009 Shaw
7,537,482 B2 5/2009 Burris et al.
7,540,759 B2 6/2009 Liu et al.
7,544,094 B1 6/2009 Paglia et al.
7,563,133 B2 7/2009 Stein
7,566,236 B2 7/2009 Malloy et al.
7,568,945 B2 8/2009 Chee et al.
7,578,693 B2 8/2009 Yoshida et al.
7,588,454 B2 9/2009 Nakata et al.
7,588,460 B2 9/2009 Malloy et al.
7,607,942 B1 10/2009 Van Swearingen
7,625,227 B1 12/2009 Henderson et al.
7,632,143 B1 12/2009 Islam
7,635,283 B1 * 12/2009 Islam ..... H01R 9/05 439/583
7,648,383 B2 1/2010 Burris et al.
7,651,376 B2 1/2010 Schreier
7,674,132 B1 3/2010 Chen
7,682,177 B2 3/2010 Berthet
7,682,188 B1 3/2010 Lu
7,694,420 B2 4/2010 Ehret et al.
7,714,229 B2 5/2010 Burris et al.
7,726,996 B2 6/2010 Burris et al.
7,727,011 B2 6/2010 Montena et al.
7,749,021 B2 7/2010 Brodeur
7,749,022 B2 7/2010 Amidon et al.
7,753,705 B2 7/2010 Montena
7,753,710 B2 7/2010 George
7,753,727 B1 7/2010 Islam et al.
7,758,356 B2 7/2010 Burris et al.
7,758,370 B1 7/2010 Flaherty
7,794,275 B2 * 9/2010 Rodrigues ..... H01R 9/05 439/584
7,806,714 B2 10/2010 Williams et al.
7,806,725 B1 10/2010 Chen
7,811,133 B2 10/2010 Gray
7,814,654 B2 10/2010 Pichler
D626,920 S 11/2010 Purdy et al.
7,824,216 B2 11/2010 Purdy
7,828,594 B2 11/2010 Burris et al.
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,845,980 B1 12/2010 Amidon
7,850,472 B2 12/2010 Friedrich et al.
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 2/2011 Chen
7,914,326 B2 3/2011 Sutter
7,918,687 B2 4/2011 Paynter et al.
7,927,135 B1 4/2011 Wlos
7,934,954 B1 5/2011 Chawgo et al.
7,934,955 B1 5/2011 Hsia
7,938,662 B2 5/2011 Burris et al.
7,942,695 B1 5/2011 Lu
7,950,958 B2 5/2011 Mathews
7,950,961 B2 5/2011 Chabalowski et al.
7,955,126 B2 6/2011 Bence et al.
7,972,158 B2 7/2011 Wild et al.
7,972,176 B2 7/2011 Burris et al.
7,982,005 B2 7/2011 Ames et al.
8,011,955 B1 9/2011 Lu
8,025,518 B2 9/2011 Burris et al.
8,029,315 B2 10/2011 Purdy et al.
8,029,316 B2 10/2011 Snyder et al.
8,037,599 B2 10/2011 Pichler
8,047,872 B2 11/2011 Burris et al.
8,062,044 B2 11/2011 Montena et al.
8,062,063 B2 11/2011 Malloy et al.
8,070,504 B2 12/2011 Amidon et al.
8,075,337 B2 12/2011 Malloy et al.
8,075,338 B1 12/2011 Montena
8,079,860 B1 12/2011 Zraik
8,087,954 B2 1/2012 Fuchs
8,113,875 B2 2/2012 Malloy et al.
8,113,879 B1 2/2012 Zraik
8,157,587 B2 4/2012 Paynter et al.
8,157,588 B1 4/2012 Rodrigues et al.
8,167,635 B1 5/2012 Mathews
8,167,636 B1 5/2012 Montena
8,172,612 B2 5/2012 Bence et al.
8,177,572 B2 5/2012 Feye-Hohmann
8,192,237 B2 * 6/2012 Purdy ..... H01R 9/0524 439/584
8,206,172 B2 6/2012 Katagiri et al.
D662,893 S 7/2012 Haberek et al.
8,231,412 B2 7/2012 Paglia et al.
8,262,408 B1 9/2012 Kelly
8,272,893 B2 9/2012 Burris et al.
8,287,310 B2 10/2012 Burris et al.
8,287,320 B2 10/2012 Purdy et al.
8,313,345 B2 11/2012 Purdy
8,313,353 B2 11/2012 Purdy et al.
8,317,539 B2 11/2012 Stein
8,319,136 B2 11/2012 Byron et al.
8,323,053 B2 12/2012 Montena
8,323,058 B2 12/2012 Flaherty et al.
8,323,060 B2 12/2012 Purdy et al.
8,337,229 B2 12/2012 Montena
8,366,481 B2 2/2013 Ehret et al.
8,366,482 B2 2/2013 Burris et al.
8,376,769 B2 2/2013 Holland et al.
D678,844 S 3/2013 Haberek
8,398,421 B2 3/2013 Haberek et al.
8,430,688 B2 4/2013 Montena et al.
8,449,326 B2 5/2013 Holland et al.
8,465,322 B2 6/2013 Purdy
8,469,739 B2 6/2013 Rodrigues et al.
8,469,740 B2 6/2013 Ehret et al.
D686,164 S 7/2013 Haberek et al.
D686,576 S 7/2013 Haberek et al.
8,475,205 B2 7/2013 Ehret et al.
8,480,430 B2 7/2013 Ehret et al.
8,480,431 B2 7/2013 Ehret et al.
8,485,845 B2 7/2013 Ehret et al.
8,506,325 B2 * 8/2013 Malloy ..... H01R 13/187 439/578
8,517,763 B2 8/2013 Burris et al.
8,517,764 B2 8/2013 Wei et al.

(56) References Cited

U.S. PATENT DOCUMENTS 8,529,279 B2 9/2013 Montena
8,550,835 B2 10/2013 Montena
8,556,656 B2 10/2013 Thomas et al.
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,622,776 B2 1/2014 Morikawa
8,636,529 B2 1/2014 Stein
8,636,541 B2 1/2014 Chastain et al.
8,647,136 B2 2/2014 Purdy et al.
7,114,990 C1 4/2014 Bence et al.
8,690,603 B2 4/2014 Bence et al.
8,721,365 B2 5/2014 Holland
8,727,800 B2 5/2014 Holland et al.
8,758,050 B2 6/2014 Montena
8,777,658 B2 7/2014 Holland et al.
8,777,661 B2 7/2014 Holland et al.
8,172,612 C1 9/2014 Bence et al.
8,834,200 B2 9/2014 Shaw
8,858,251 B2 10/2014 Montena
8,888,526 B2 11/2014 Burris
8,920,192 B2 12/2014 Montena
6,558,194 C1 1/2015 Montena
6,848,940 C1 1/2015 Montena
9,017,101 B2 4/2015 Ehret et al.
9,048,599 B2 6/2015 Burris
9,153,911 B2 10/2015 Burris et al.
9,166,307 B2 10/2015 Shaw
9,166,348 B2 10/2015 Burris et al.
9,172,154 B2 10/2015 Burris
9,172,157 B2 10/2015 Burris
9,306,324 B2 4/2016 Wei
9,343,855 B2 5/2016 Wei
2001/0034143 A1 10/2001 Annequin
2001/0046802 A1 11/2001 Perry et al.
2001/0051448 A1 12/2001 Gonzalez
2002/0013088 A1 1/2002 Rodrigues et al.
2002/0019161 A1 2/2002 Finke et al.
2002/0038720 A1 4/2002 Kai et al.
2002/0064014 A1 5/2002 Montena
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0137778 A1 7/2004 Mattheeuws et al.
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0085125 A1* 4/2005 Montena ..... H01R 9/0518 439/578
2005/0159045 A1 7/2005 Huang
2005/0164553 A1* 7/2005 Montena ..... H01R 9/0518 439/578
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1 5/2006 Matthews
2006/0113107 A1 6/2006 Williams
2006/0154519 A1 7/2006 Montena
2006/0166552 A1 7/2006 Bence et al.
2006/0178046 A1 8/2006 Tusini
2006/0194465 A1 8/2006 Czikora
2006/0199040 A1 9/2006 Yamada
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0093128 A1 4/2007 Thomas et al.
2007/0123101 A1 5/2007 Palinkas
2007/0155232 A1 7/2007 Burris et al.
2007/0155233 A1* 7/2007 Laerke ..... H01R 9/0521 439/578
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0274644 A1 11/2008 Rodrigues
2008/0289470 A1 11/2008 Aston
2008/0310026 A1 12/2008 Nakayama
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy
2010/0255720 A1 10/2010 Radzik et al.
2010/0255721 A1 10/2010 Purdy et al.
2010/0273351 A1 10/2010 Holliday
2010/0279548 A1 11/2010 Montena et al.
2010/0297871 A1 11/2010 Haube
2010/0297875 A1 11/2010 Purdy et al.
2010/0304579 A1 12/2010 Kisling
2010/0323541 A1 12/2010 Amidon et al.
2011/0021072 A1 1/2011 Purdy
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 5/2011 Paglia et al.
2011/0117774 A1 5/2011 Malloy et al.
2011/0143567 A1 6/2011 Purdy et al.
2011/0151714 A1 6/2011 Flaherty et al.
2011/0230089 A1 9/2011 Amidon et al.

(56) References Cited

U.S. PATENT DOCUMENTS

| | | | | |
|---|---|---|---|---|
| 2011/0230091 | A1 | 9/2011 | Krenceski et al. | |
| 2011/0237123 | A1 | 9/2011 | Burris et al. | |
| 2011/0237124 | A1 | 9/2011 | Flaherty et al. | |
| 2011/0250789 | A1 | 10/2011 | Burris et al. | |
| 2011/0318958 | A1 | 12/2011 | Burris et al. | |
| 2012/0021642 | A1 | 1/2012 | Zraik | |
| 2012/0040537 | A1 | 2/2012 | Burris | |
| 2012/0045933 | A1 | 2/2012 | Youtsey | |
| 2012/0064768 | A1 | 3/2012 | Islam et al. | |
| 2012/0094530 | A1 | 4/2012 | Montena | |
| 2012/0100751 | A1 | 4/2012 | Montena | |
| 2012/0108098 | A1 | 5/2012 | Burris et al. | |
| 2012/0122329 | A1 | 5/2012 | Montena | |
| 2012/0129387 | A1 | 5/2012 | Holland et al. | |
| 2012/0159740 | A1* | 6/2012 | Strelow | H02G 3/0658 16/2.2 |
| 2012/0171894 | A1 | 7/2012 | Malloy et al. | |
| 2012/0178289 | A1 | 7/2012 | Holliday | |
| 2012/0202378 | A1 | 8/2012 | Krenceski et al. | |
| 2012/0222302 | A1 | 9/2012 | Purdy et al. | |
| 2012/0225581 | A1 | 9/2012 | Amidon et al. | |
| 2012/0315788 | A1 | 12/2012 | Montena | |
| 2012/0329311 | A1* | 12/2012 | Duval | H01R 13/59 439/449 |
| 2013/0059468 | A1 | 3/2013 | Wood | |
| 2013/0065433 | A1 | 3/2013 | Burris | |
| 2013/0072057 | A1 | 3/2013 | Burris | |
| 2013/0178096 | A1 | 7/2013 | Matzen | |
| 2013/0273761 | A1 | 10/2013 | Ehret et al. | |
| 2014/0106612 | A1 | 4/2014 | Burris | |
| 2014/0106614 | A1* | 4/2014 | Burris | H01R 9/0527 439/578 |
| 2014/0120766 | A1 | 5/2014 | Meister et al. | |
| 2014/0137393 | A1 | 5/2014 | Chastain et al. | |
| 2014/0148044 | A1* | 5/2014 | Balcer | H01R 9/0524 439/460 |
| 2014/0148051 | A1 | 5/2014 | Bence et al. | |
| 2014/0154907 | A1 | 6/2014 | Ehret et al. | |
| 2014/0106613 | A1 | 7/2014 | Burris | |
| 2014/0298650 | A1 | 10/2014 | Chastain et al. | |
| 2014/0322968 | A1 | 10/2014 | Burris | |
| 2014/0342605 | A1 | 11/2014 | Burris et al. | |
| 2015/0044905 | A1* | 2/2015 | Burris | H01R 9/0524 439/578 |
| 2015/0118901 | A1 | 4/2015 | Burris | |
| 2015/0295331 | A1 | 10/2015 | Burris | |
| 2016/0118727 | A1 | 4/2016 | Burris et al. | |
| 2016/0118748 | A1 | 4/2016 | Burris et al. | |
| 2017/0025801 | A1 | 1/2017 | Edmonds | |

FOREIGN PATENT DOCUMENTS

| | | |
|---|---|---|
| CN | 1292940 | 4/2001 |
| CN | 201149936 | 11/2008 |
| CN | 201149937 | 11/2008 |
| CN | 201178228 | 1/2009 |
| CN | 201904508 | 7/2011 |
| DE | 47931 | 10/1888 |
| DE | 102289 | 7/1897 |
| DE | 1117687 | 11/1961 |
| DE | 2261973 | 6/1974 |
| DE | 3117320 | 4/1982 |
| DE | 3211008 | 10/1983 |
| DE | 9001608.4 | 4/1990 |
| DE | 4439852 | 5/1996 |
| DE | 19749130 | 8/1999 |
| DE | 19957518 | 9/2001 |
| DE | 10346914 | 5/2004 |
| DE | 102004031271 | 1/2006 |
| DE | 102010064071 | 12/2010 |
| EP | 115179 | 8/1984 |
| EP | 116157 | 8/1984 |
| EP | 167738 | 1/1986 |
| EP | 72104 | 2/1986 |
| EP | 223464 | 5/1987 |
| EP | 265276 | 4/1988 |
| EP | 350835 | 1/1990 |
| EP | 428424 | 5/1991 |
| EP | 867978 | 9/1998 |
| EP | 1069654 | 9/1998 |
| EP | 1094565 | 4/2001 |
| EP | 1115179 | 7/2001 |
| EP | 1191268 | 3/2002 |
| EP | 1455420 | 9/2004 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2204331 | 5/1974 |
| FR | 2232846 | 1/1975 |
| FR | 2462798 | 2/1981 |
| FR | 2494508 | 5/1982 |
| GB | 589697 | 6/1947 |
| GB | 1010372 | 11/1963 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 2000-40564 | 2/2000 |
| JP | 2002-015823 | 1/2002 |
| JP | 200215823 | 1/2002 |
| JP | 4129978 | 8/2008 |
| JP | 4219778 | 2/2009 |
| JP | 2009277571 | 11/2009 |
| JP | 4391268 | 12/2009 |
| JP | 4503793 | 7/2010 |
| KR | 100622526 | 9/2006 |
| TW | 427044 | 3/2001 |
| TW | 200810279 | 2/2008 |
| TW | 200843262 | 11/2008 |
| TW | 201140953 | 11/2011 |
| WO | 8700351 | 1/1987 |
| WO | 9908343 | 2/1999 |
| WO | 00/05785 | 2/2000 |
| WO | 186756 | 11/2001 |
| WO | 2069457 | 9/2002 |
| WO | 2004013883 | 2/2004 |
| WO | 2004098795 | 11/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2012162431 | 5/2011 |
| WO | 2011128665 | 10/2011 |
| WO | 2011128666 | 10/2011 |
| WO | 2013126629 | 8/2013 |

OTHER PUBLICATIONS

Search Report dated Mar. 19, 2013 pertaining to International application No. PCT/US2013/20001.

Office Action dated Feb. 29, 2016 pertaining to U.S. Appl. No. 14/795,367.

Office Action dated May 3, 2016 pertaining to U.S. Appl. No. 14/750,435.

Office Action dated May 20, 2016 pertaining to U.S. Appl. No. 13/927,537.

Chinese Search Report dated Jan. 19, 2016 pertaining to Chinese Application No. 2013800048358.

Taiwan Search Report dated Mar. 28, 2016 pertaining to Taiwanese Application No. 102100147.

(56) References Cited

OTHER PUBLICATIONS

Corning Gilbert 2004 OEM Coaxial Products Catalog, Quick Disconnects, 2 pages.
Digicon AVL Connector. ARRIS Group Inc. [online] 3 pages. Retrieved from the Internet: <URL: http://www.arrisi.com/special/digiconAVL.asp.
U.S. Office Action, U.S. Appl. No. 10/997,218; dated Jul. 31, 2006, pp. 1-10.
Society of Cable Telecommunications Engineers, Engineering Committee, Interface Practices Subcommittee; American National Standard; ANSI/SCTE Jan. 2006; Specification for "F" Port, Female, Outdoor. Published Jan. 2006. 9 pages.
The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.
Notice of Allowance (dated Mar. 20, 2012) for U.S. Appl. No. 13/117,843.
Search Report dated Jun. 6, 2014 pertaining to International application No. PCT/US2014/023374.
Search Report dated Apr. 9, 2014 pertaining to International application No. PCT/US2014/015934.
Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.
PPC, "Next Generation Compression Connectors," pp. 1-6, Retrieved from http://www.tessco.com/yts/partnearnanufacturer list/vendors/ppc/pdf/ppcdigital spread.pdf.
Patent Cooperation Treaty, International Search Report for PCT/US2013/070497, dated Feb. 11, 2014, 3 pgs.
Patent Cooperation Treaty, International Search Report for PCT/US2013/064515, 10 pgs.
Patent Cooperation Treaty, International Search Report for PCT/US2013/064512, dated Jan. 21, 2014, 11 pgs.
Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.
Slade, Paul G,. Electrical Contacts: Principles and Applications, 1999, Retrieved from http://books.google.com/books (table of contents only).
U.S. Reexamination Control No. 95/002,400 filed Sep. 15, 2012, regarding U.S. Pat. No. 8,192,237 filed Feb. 23, 2011 (Purdy et al.).
U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).
U.S. Inter Partes Review Case No. 2013-00343 filed Jun. 10, 2013, regarding U.S. Pat. No. 8,313,353 filed Apr. 30, 2012, claims 1-6 (Purdy et al.).
U.S. Inter Partes Review Case No. 2013-00340 filed Jun. 10, 2013, regarding U.S. Pat. No. 8,323,060 filed Jun. 14, claims 1-9 (Purdy et al.).
U.S. Inter Partes Review Case No. 2013-00347 filed Jun. 10, 2013, regarding U.S. Pat. No. 8,287,320 filed Dec. 8, 2009, claims 9, 17, 32 (Purdy et al.).
U.S. Inter Partes Review Case No. 2013-00345 filed Jun. 10, 2013, regarding U.S. Pat. No. 8,313,353 filed Apr. 30, 2012, claims 7-27 (Purdy et al.).
U.S. Inter Partes Review Case No. 2013-00342 filed Jun. 10, 2013, regarding U.S. Pat. No. 8,323,060 filed Jun. 14, 2012, claims 10-25 (Purdy et al.).
U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Office Action dated Jun. 12, 2014 pertaining to U.S. Appl. No. 13/795,737.
Office Action dated Aug. 25, 2014 pertaining to U.S. Appl. No. 13/605,481.
Election/Restrictions Requirement dated Jul. 31, 2014 pertaining to U.S. Appl. No. 13/652,969.
Office Action dated Aug. 29, 2014 pertaining to U.S. Appl. No. 13/827,522.
Election/Restrictions Requirement dated Jun. 20, 2014 pertaining to U.S. Appl. No. 13/795,780.
Office Action dated Sep. 19, 2014 pertaining to U.S. Appl. No. 13/795,780.
Office Action dated Oct. 6, 2014 pertaining to U.S. Appl. No. 13/732,679.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Mar. 19, 2015 pertaining to U.S. Appl. No. 13/795,780.
Patent Cooperation Treaty, International Search Report for PCT/US2014/037841, dated Aug. 19, 2014, 3 pages.
Office Action dated Jun. 24, 2015 pertaining to U.S. Appl. No. 13/652,969.
Patent Cooperation Treaty, International Preliminary Report on Patentability for PCT/US2013/064512, dated Apr. 30, 2015, 9 pages.
Patent Cooperation Treaty, International Preliminary Report on Patentability for PCT/US2013/064515, dated Apr. 30, 2015, 8 pages.
Office Action dated Jun. 24, 2015 pertaining to U.S. Appl. No. 14/259,703.
Office Action dated Jul. 20, 2015 pertaining to U.S. Appl. No. 14/279,870.
Office Action dated Feb. 2, 2016 pertaining to U.S. Appl. No. 14/259,703.
Office Action dated Oct. 7, 2015 pertaining to U.S. Appl. No. 13/927,537.
Search Report dated Oct. 7, 2014 pertaining to International application No. PCT/US2014/043311.
Report on the Filing or Determination of an Action Regarding a Patent or Trademark regarding U.S. Pat. No. 8,313,353; U.S. Pat. No. 8,313,345; U.S. Pat. No. 8,323,060—Eastern District of Arkansas.
Report on the Filing or Determination of an Action Regarding a Patent or Trademark regarding U.S. Pat. No. 8,192,237; U.S. Pat. No. 8,287,320; U.S. Pat. No. 8,313,353; U.S. Pat. No. 8,323,060—Northern District of New York.

(56) References Cited

OTHER PUBLICATIONS

Report on the Filing or Determination of an Action Regarding a Patent or Trademark regarding U.S. Pat. No. 8,562,366—Northern District of New York.
International Search Report and Written Opinion of the International Searching Authority; PCT/US2016/017294; dated May 11, 2016.
Office Action dated Mar. 10, 2016 pertaining to U.S. Appl. No. 14/166,653.
Office Action dated Aug. 26, 2016 pertaining to U.S. Appl. No. 15/019,498.
Office Action dated Sep. 1, 2016 pertaining to U.S. Appl. No. 14/259,703.
Office Action dated Sep. 23, 2016 pertaining to U.S. Appl. No. 14/872,842.
Notice of Allowance dated Sep. 23, 2016 pertaining to U.S. Appl. No. 13/927,537.
Notice of Allowance dated Sep. 19, 2016 pertaining to U.S. Appl. No. 14/928,552.
Office Action dated Jul. 5, 2016 pertaining to U.S. Appl. No. 14/795,367.
Office Action dated Nov. 7, 2016 pertaining to U.S. Appl. No. 15/278,825.
Apple Rubber Products Seal Design Guide 75; Mary K. Chaffee et al eds.; 2009; available at http://www.applerubber.com/src/pdf/seal-design-guide.pdf.
Whitlock, J. et al.; The Seal Man's O'Ring Handbook; Eric Jackson ed.; EPM, Inc.; 1st ed. 2004; pp. 1-36; available at https://www.physics.harvard.edu/uploads/files/machineshop/epm_oring_handbook.pdf.
O-Ring Identification Chart; Universal Air Conditioner, Inc.; available at https://www.uacparts.com/Downloads/UAC%20Oring%20Chart.pdf.
Office Action dated May 5, 2017 pertaining to U.S. Appl. No. 15/255,625.
Office Action dated Jul. 25, 2017 pertaining to U.S. Appl. No. 14/259,703.
Ex Parte Quayle dated May 18, 2017 pertaining to U.S. Appl. No. 15/342,709.
Office Action dated May 9, 2017 pertaining to U.S. Appl. No. 14/884,385.
Corning Cablecon CX3 Compression Catalogue; Rev. May 2012; 16 pages.
TW102137009 Search Report dated Sep. 26, 2016; 1 page, Taiwan Patent Office.
Office Action dated Nov. 29, 2016 pertaining to U.S. Appl. No. 14/844,592.

* cited by examiner

CABLE OR CONDUIT CONNECTOR WITH JACKET RETENTION FEATURE

RELATED APPLICATIONS

This application claims the benefit of priority under 35 U.S.C. § 119 of U.S. Provisional Application No. 62/118,598 filed on Feb. 20, 2015, the content of which is relied upon and incorporated herein by reference in its entirety.

BACKGROUND

Field

The present disclosure generally relates to coaxial cable connectors.

Technical Background

A coaxial cable includes an inner conductor, a dielectric surrounding the inner conductor, an outer conductor surrounding the dielectric and an outer jacket. In some circumstances, it may be desirable to separate and remove the dielectric and inner conductor from the outer conductor of the coaxial cable. For example, in situations where new fiber optic cable is to be laid in a neighborhood with an existing coaxial cable infrastructure, it may be less expensive and quicker to run the fiber optic cable through the existing coaxial cable infrastructure. In order to run fiber optic cable through an existing coaxial cable infrastructure, the dielectric and inner conductor must be separated and removed from the outer conductor, leaving behind the outer conductor surrounded by an outer jacket through which the fiber optic cable may be installed.

Accordingly, a need exists for connectors used for removing a cable core from a coaxial cable and/or attaching a coaxial cable outer conductor and jacket from which a cable core has been removed.

SUMMARY

Connectors are provided for use in removing a cable core from a coaxial hardline cable and for attaching a thin-wall coaxial cable outer conductor and jacket from which a cable core has been removed. In some embodiments, connectors may function with various aspects of a cable core removal process and/or replacement of a cable core with fiber optical cables.

In one embodiment, a connector for securing an outer surface of a cable or conduit is provided. The connector includes a back coupler sleeve, an actuator sleeve and a front coupler sleeve. The back coupler sleeve includes at least one inner surface defining a back coupler sleeve opening extending through the back coupler sleeve and an outer surface. The back coupler sleeve also includes at least a partial annular ring formed along the inner surface within the back coupler sleeve opening. The connector also includes an actuator sleeve including an inner surface defining an actuator sleeve opening extending through the actuator and adapted to receive the cable, the inner surface including a tapered portion adapted to at least partially receive the annular ring of the back coupler sleeve within the actuator sleeve opening, the actuator sleeve inserted into the back coupler sleeve opening of the back coupler sleeve and disposed adjacent to the annular ring of the back coupler sleeve; and a front coupler sleeve comprising an inner surface disposed about at least a portion of the outer surface of the back coupler sleeve and adapted to engage the outer surface of the back coupler sleeve, wherein engagement of inner surface of the front coupler sleeve and the outer surface of the back coupler sleeve is adapted to displace the annular ring of the back coupler sleeve radially inwardly to secure the outer surface of the cable or conduit.

In another embodiment, a method for securing a cable or conduit in a connector is provided. In the method, an actuator sleeve is inserted into an opening of a back coupler sleeve. The back coupler sleeve includes at least one inner surface defining the opening of the back coupler sleeve, an outer surface and an at least partially annular protrusion formed along the inner surface within the back coupler sleeve opening. The actuator sleeve includes an inner surface defining an actuator sleeve opening extending through the actuator and adapted to receive the cable or conduit. The inner surface includes a tapered portion adapted to at least partially receive the annular protrusion of the back coupler sleeve within the actuator sleeve opening. The actuator sleeve is inserted into the back coupler sleeve opening of the back coupler sleeve and disposed adjacent to the annular ring of the back coupler sleeve. A cable or conduit is extended within the opening of the back coupler sleeve and the opening of the actuator sleeve. At least a portion of the outer surface of the back coupler sleeve is extended within an inner surface of a front coupler sleeve. The operation of engaging the inner surface of the front coupler sleeve and the outer surface of the back coupler sleeve displaces the at least partially annular protrusion of the back coupler sleeve radially inwardly to secure the outer surface of the cable or conduit.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate embodiments, and together with the description serve to explain principles and operation of the various embodiments.

DETAILED DESCRIPTION

Embodiments of the present disclosure are directed to connectors for use with one or more cables and/or conduits. In one embodiment, for example, a connector may be used in removing a cable core from a coaxial hardline cable and to secure a thin-wall coaxial cable outer conductor and jacket from which a cable core has been removed. In some embodiments, connectors may function with various aspects of a cable core removal process and/or replacement of a cable core with fiber optical cables. In various embodiments, connectors provided herein may also be used with standard coaxial cables as well. In other embodiments, a connector may be used to secure an outer surface of a conduit through which one or more cables (e.g., fiber optic cables) may be routed.

Figure 1:
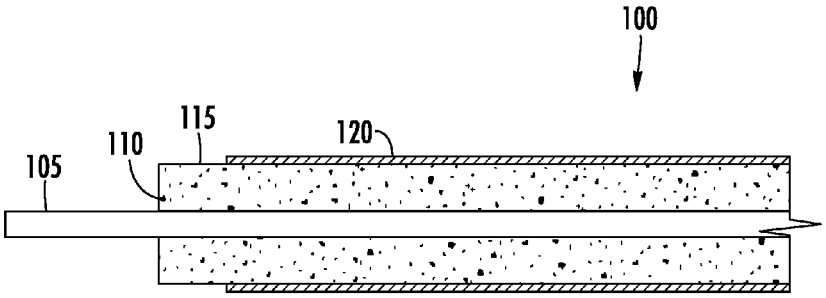
FIG. 1 schematically depicts a partial cross sectional view of a coaxial cable, according to one or more embodiments shown and described herein.

Referring now to FIG. 1, a coaxial cable 100 is schematically depicted. The coaxial cable 100 includes an inner conductor 105, a dielectric 110, and an outer conductor 115. The dielectric 110 surrounds the inner conductor 105. The outer conductor 115 surrounds the dielectric 110. In some embodiments the inner conductor 105 is copper-clad aluminum, though the inner conductor 105 may be a conductor other than copper-clad aluminum (e.g., copper, gold, or the like) in other embodiments. In some embodiments, the dielectric 110 is a plastic, though the dielectric 110 may be an insulator other than plastic in other embodiments. In some embodiments, the outer conductor 115 is aluminum, though the outer conductor 115 may be a conductor other than aluminum in other embodiments. The coaxial cable 100 further includes an outer jacket 120. In some embodiments, the outer jacket 120 is an insulator, such as, but not limited to plastic. The outer jacket 120 may comprise, for example, polyethylene and/or other plastic.

Figure 2:
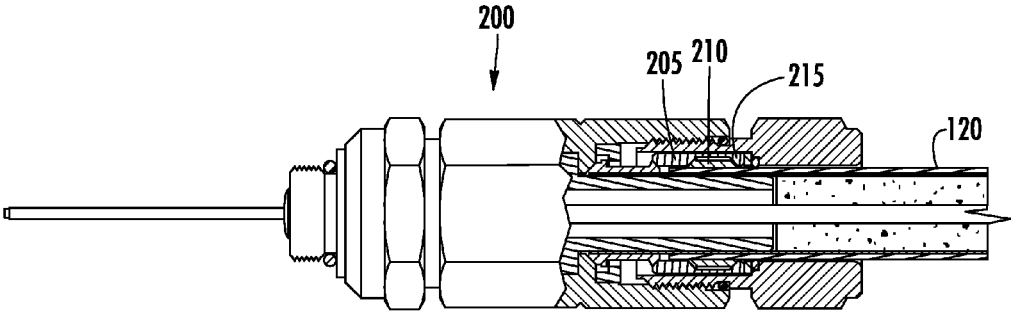
FIG. 2 schematically depicts a partial cross-sectional view of a typical hardline coaxial cable connector 200, according to one or more embodiments shown and described herein.

Referring now to FIG. 2, a partial cross-sectional view of a typical hardline coaxial cable connector 200 is depicted. The coaxial cable connector 200 is attached to a coaxial cable 100, such as shown in FIG. 1. Compression rings 205 and 215 of the coaxial connector 200 are axially moved toward each other. The compression rings 205 and 215 drive a ferrule 210 radially inwardly to clamp against the outer jacket 120 of the coaxial cable 100. This clamping action serves to anchor outer jacket 120 within connector 200 and is intended to prevent outer jacket 120 from sliding along the outside of outer conductor 115 away from connector 200 due to contractive movement caused by exposure to cold weather conditions.

Figure 3:
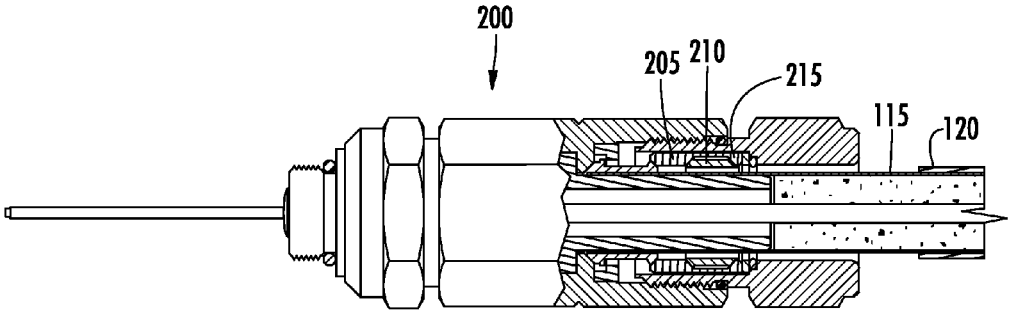
FIG. 3 schematically depicts a partial cross sectional view of the hardline coaxial cable connector shown in FIG. 2 in which the outer jacket of the coaxial cable is pulled back along the outside of outer conductor, according to one or more embodiments shown and described herein.

FIG. 3 depicts a partial cross sectional view of the hardline coaxial cable connector 200 shown in FIG. 2 in which the outer jacket 120 of the coaxial cable 100 is pulled back along the outside of outer conductor 115. The outer jacket 120 is shown pulled away from connector 200, such as might occur due to contractive movement caused by exposure to cold weather conditions and a failure of the ferrule 210. In FIG. 3, the outer conductor 115 is shown exposed to the elements and the jacket 120 no longer supports coaxial cable 100 within the connector 200. In this condition, moisture and debris may enter the connector/cable junction and outer conductor 115 may be subjected to cracking caused by bending and vibration.

Figure 4:
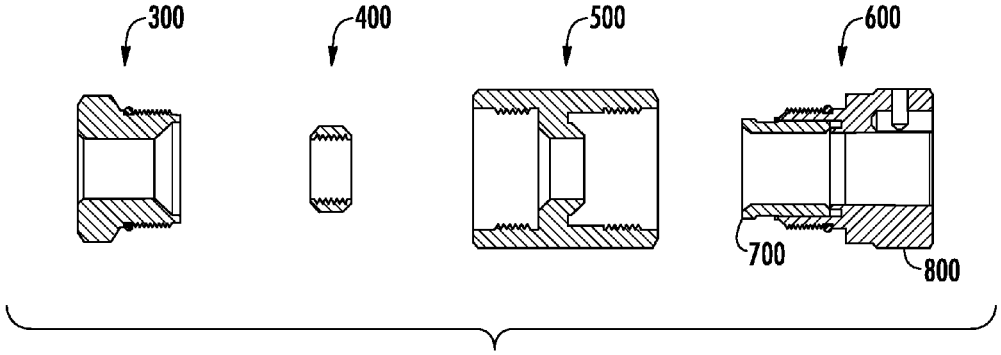
FIG. 4 schematically depicts an exploded view of components of an example embodiment of a cable connector is depicted with the individual components shown in cross-section, according to one or more embodiments shown and described herein.

Referring now to FIG. 4, an exploded view of components of an example embodiment of a cable connector 250 is depicted with the individual components shown in cross-section. In this embodiment, the cable connector 250 comprises a packing coupler sleeve or nut 300, a packing sleeve 400, a main/front coupler sleeve or nut 500, and a sub-assembly 600 that interact together to grasp an outer jacket of a cable, such as the coaxial cable 100 shown in FIG. 1. The sub-assembly 600, in this embodiment, includes an actuator sleeve 700 assembled with a back coupler sleeve/nut 800. The individual packing coupler sleeve or nut 300, packing sleeve 400, main/front sleeve or nut 500 and sub-assembly 600 components of the cable connector 250 are further described with reference to FIGS. 5 through 10.

Figure 5:
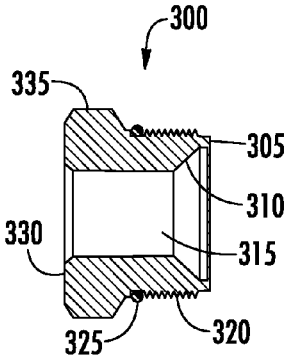
FIG. 5 schematically depicts a cross-sectional view of the packing nut shown in FIG. 4, according to one or more embodiments shown and described herein.

Referring now to FIG. 5, a cross-sectional view of the packing coupler sleeve or nut 300 shown in FIG. 4 is depicted. The packing coupler sleeve/nut 300 may be constructed of a conductor, such as aluminum. The packing nut 300 may also be finished with a coating, such as an iridite coating and dry-lube. In this embodiment, the packing nut 300 comprises a front end 305 and a back end 330. A through-bore 315 extends through packing nut 300 between the front end 305 and the back end 330. A front portion of the through-bore is defined by a conical portion 310 that extends axially from the front end 305. A threaded portion 320 is disposed along an exterior surface 335 of the packing nut 300. In the embodiment shown in FIG. 5, an O-ring 325 is also shown disposed along the exterior surface 335 of the packing nut 300 rearward of and adjacent to the threaded portion 320 of the packing nut 300. Although the packing nut 300 is shown in FIG. 5 as including the O-ring 325, the packing nut may not include an O-ring and/or may include another type of sealing mechanism.

Figure 6:
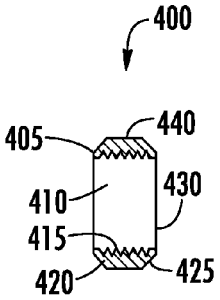
FIG. 6 schematically depicts a cross-sectional view of the packing shown in FIG. 4, according to one or more embodiments shown and described herein.

Referring now to FIG. 6, a cross-sectional view of the packing sleeve 400 shown in FIG. 4 is depicted. The packing sleeve 400, for example, may be constructed of an insulator, such as a plastic material (e.g., acetal). In this embodiment, the packing sleeve 400 comprises a back end 405, a front end 430 and an opening extending through the packing sleeve 400 between the back end 405 and the front end 430. A plurality of grooves or ridges 415 are formed along an interior surface of the packing sleeve 400 and are adapted for gripping a cable jacket or tubing as described below with reference to FIG. 15. The packing sleeve 400 further comprises a back tapered portion 420 and a front tapered portion 425. The back tapered portion 420 is formed along an exterior surface 440 of the packing sleeve 400 and extends from the back end 405 of the packing sleeve 400. The front tapered portion 425 is formed along the exterior surface 440 of the packing sleeve 400 extending from the front end of the packing sleeve 400.

Figure 7:
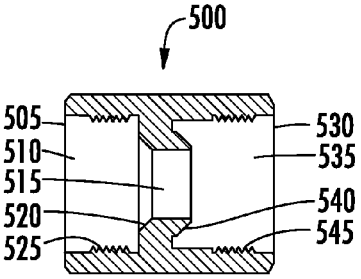
FIG. 7 schematically depicts a cross-sectional view of the main nut shown in FIG. 4, according to one or more embodiments shown and described herein.

Referring now to FIG. 7, a cross-sectional view of the main/front coupler sleeve/nut 500 shown in FIG. 4 is depicted. In this embodiment, the main coupler sleeve/nut 500 may be constructed of a conductor, such as aluminum. The main nut 500 may also be finished with a coating, such as an iridite coating and dry-lube. The main nut 500 comprises a front end 505, a back end 530 and a through-bore 515 extending through the main nut 500 between the front end 505 and the back end 530. The through-bore 515 includes a first, front opening 510 extending from the front end 505, a second, back opening 535 extending from the back end 530, and a central opening extending between the first, front opening 510 and the second, back opening 535. The central opening includes a conical portion 520 extending away from the first, front opening 510 toward the second, back opening 535. A first, front threaded portion 525 is formed along an interior surface of the main nut 500 within at least a portion of the first, front opening 510. A second, back threaded portion 545 is formed along an interior surface of the main nut 500 within at least a portion of the second, back opening 535. The main nut 500 further includes a frustoconical portion 540 formed within the through-bore 515.

Figure 8:
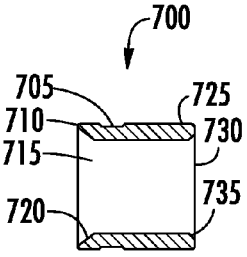
FIG. 8 schematically depicts a cross-sectional view of the actuator of the sub-assembly shown in FIG. 4, according to one or more embodiments shown and described herein.

FIG. 8 depicts a cross-sectional view of the actuator sleeve 700 of the sub-assembly 600 shown in FIG. 4. The actuator sleeve 700 may be constructed of a conductor, such as aluminum. The actuator sleeve 700 may also be finished with a coating, such as an iridite coating and dry-lube. In this embodiment, the actuator sleeve 700 comprises a front end 710, a back end 730 and a passage 715 defined by an interior surface of the actuator sleeve 700 and extending through the actuator sleeve 700 between the front end 710 and the back end 730. The actuator sleeve 700 further comprise a recess 705 formed in an exterior surface 725 of the actuator sleeve 700. In this embodiment, the interior surface of the actuator sleeve 700 includes a first, front tapered surface 720 extending in a rearward direction away from the front end 710 and a second, back tapered surface 735 extending in a frontward direction away from the back end 730.

Figure 9:
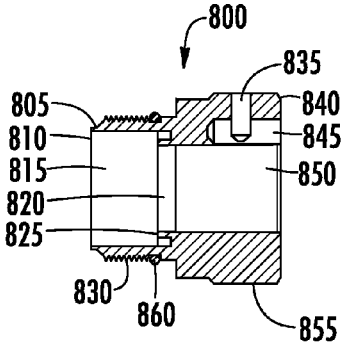
FIG. 9 schematically depicts a cross-sectional view of the back nut of the sub-assembly shown in FIG. 4, according to one or more embodiments shown and described herein.

FIG. 9 depicts a cross-sectional view of the back coupler sleeve/nut 800 of the sub-assembly 600 shown in FIG. 4. The back coupler sleeve/nut 800 may be constructed of a conductor, such as aluminum. The back coupler sleeve/nut 800 may also be finished with a coating, such as an iridite coating and dry-lube. In this embodiment, the back nut 800 includes a front end 810, a back end 840 and an opening 815 extending through the back nut between the front end 810 and the back end 840. The opening 815 includes a front bore 820 and a back bore 850. A front lip 805 is formed along an exterior surface 855 of the back nut 800 at or adjacent to the front end 810. An external threaded portion 830 is formed along the exterior surface 855 extending in a rearward direction away from the front lip 805. An annular ring 825 is also formed within the opening 815 of the back nut 800. In various embodiments, the annular ring may comprise at least a partial annular ring that extends partially or completely around the interior surface of the back coupler sleeve/nut 800.

In the particular embodiment shown in FIG. 9, the back nut 800 further includes a threaded hole 835 adapted to receive a set screw. A bonding port 845 is also formed in an axial direction between the exterior and interior surfaces of the back nut 800 extending from the back end 840. In the particular embodiment shown in FIG. 9, an O-ring 860 is disposed adjacent the threaded portion 830 extending around the exterior surface 855 of the back nut 800. The back nut 800, however, may be constructed without an O-ring 860 or may include a different sealing device than the O-ring 860 shown.

Figure 10:
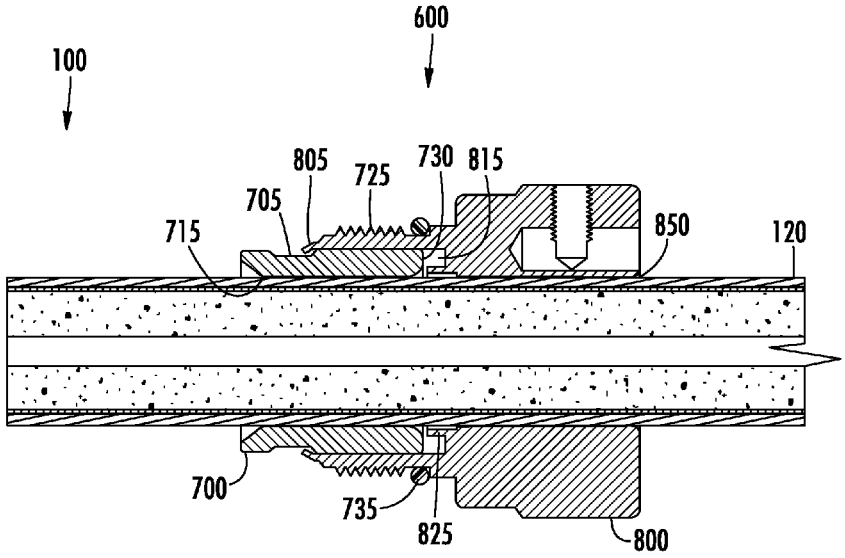
FIG. 10 schematically depicts a cross-sectional view of the sub-assembly shown in FIG. 4 having coaxial cable inserted therethrough, according to one or more embodiments shown and described herein.

FIG. 10 depicts a cross-sectional view of the sub-assembly 600 shown in FIG. 4 having coaxial cable 100 inserted therethrough. In the embodiment shown in FIG. 10, the sub-assembly 600 includes the actuator sleeve 700 inserted into an opening 815 of the back nut 800. An exterior surface 725 of the actuator sleeve 700 is sized such that there is radial clearance between the exterior surface 725 of the actuator sleeve 700 and the opening 815 of the back nut 800 allowing movement between actuator sleeve 700 and back nut 800. The lip 805 of back nut 800, in this embodiment, is rolled radially inwardly about the circumference of recess 705 of actuator sleeve 700 thus limiting axial movement of the actuator sleeve 700 within opening 815 and prevents separation of the actuator sleeve 700 from the back nut 800. In this condition, the back end 730 and, more specifically, the tapered surface 735 of the actuator sleeve 700 are allowed clearance from the annular ring 825 of the back nut 800. The passage 715 of the actuator sleeve 700 and the through-bore 850 of the back nut 800 are sized to provide clearance between actuator sleeve 700, back nut 800 and cable jacket 120 of cable 100. As such, in this embodiment, the sub assembly 600 is free to slide along cable 100 in an unimpeded manner.

Figure 11:
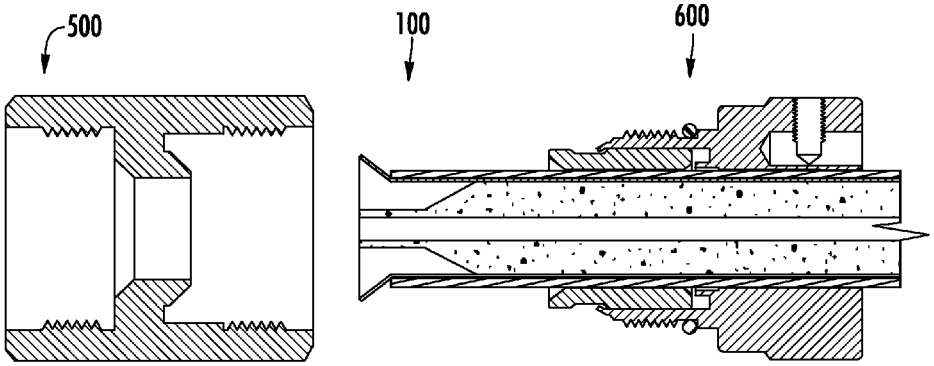
FIG. 11 schematically depicts a cross-sectional view of the sub-assembly shown in FIG. 4 having coaxial cable inserted therethrough, according to one or more embodiments shown and described herein.

FIG. 11 depicts a cross-sectional view of the sub-assembly 600 having a coaxial cable 100 inserted therethrough. In the FIG. 11, the coaxial cable 100 has been prepared and flared for removal of the cable dielectric material 110 and the inner conductor 105. The main/front nut 500 is introduced in preparation for assembly with the sub-assembly 600 as described below with reference to FIG. 12.

Figure 12:
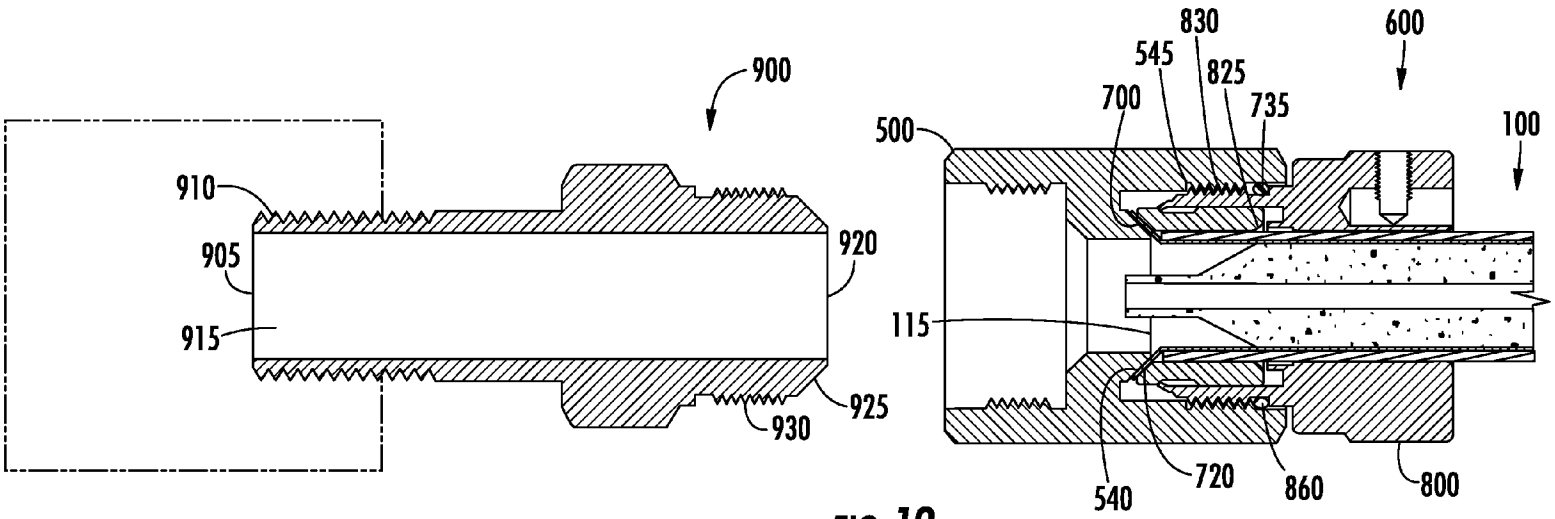
FIG. 12 schematically depicts a cross-sectional view of a fluid adaptor, a main nut and a sub-assembly, according to one or more embodiments shown and described herein.

FIG. 12 depicts a cross-sectional view of a fluid adaptor 900 being introduced in preparation for assembly with the main nut 500 and the sub-assembly 600. In this embodiment, the main nut 500 is assembled with the sub-assembly 600 by engaging a threaded portion 545 of the main nut 500 with a threaded portion 830 of the back nut 800. A coaxial cable outer conductor 115 is captured between a frustoconical portion 540 of the main nut 500 and the tapered surface 720 of actuator sleeve 700 providing mechanical, environmental, and pressure sealing. Additionally, the capturing of cable outer conductor 115 between frustoconical portion 540 of main nut 500 and tapered surface 720 of actuator sleeve 700 provides an electrical ground path between the coaxial cable 100 outer conductor 115 and the connector. Further, engagement of the threaded portion 545 of the main nut 500 and the threaded portion 830 of the back nut 800 drives the back nut 800 axially forward in relation to the actuator sleeve 700 causing the annular ring 825 of the back nut 800 to be forced against the tapered surface 735 of actuator sleeve 700. Yet further engagement of threaded portion 545 of the main nut 500 and the threaded portion 830 of the back nut 800 drives the annular ring 825 radially inwardly along a contour of the tapered surface 735 of the actuator sleeve 700 causing the annular ring 825 to close about and at least partially circumferentially indent or dig/press into the outer jacket 120 of the coaxial cable 100 both grasping the coaxial cable outer jacket 120 to prevent it from unwanted rearward movement under temperature extremes and sealing the junction between cable jacket 120 and the annular ring 825 of the back nut 800 against moisture ingress. Various embodiments may be constructed with or without the O-ring 860. In one embodiment, for example, the fluid adaptor 900 is introduced into the connector in preparation for the next step of the process as seen in FIG. 13.

Figure 13:
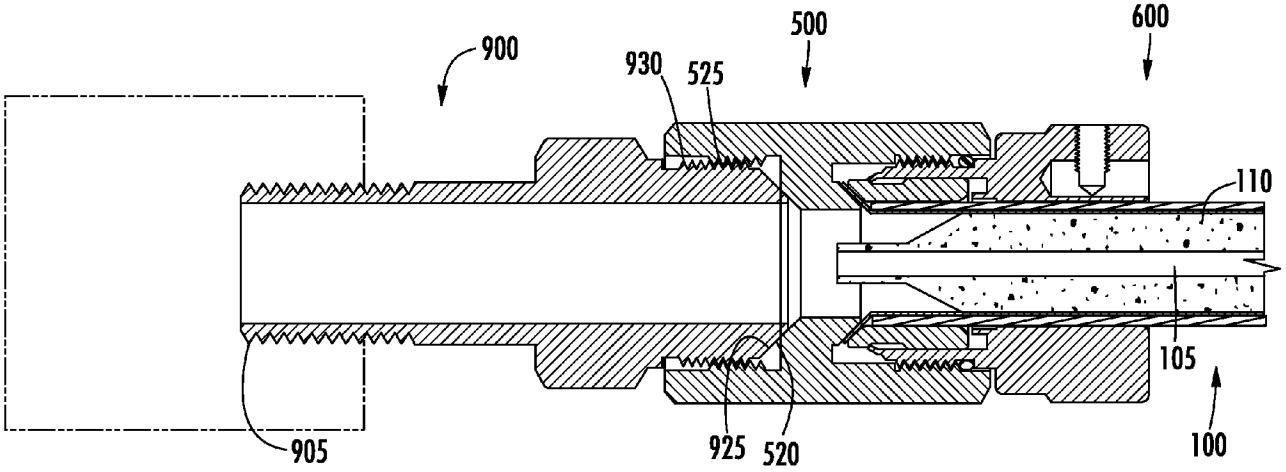
FIG. 13 schematically depicts a cross-sectional view of the fluid adaptor engaged with the cable connector of FIG. 10, according to one or more embodiments shown and described herein.

FIG. 13 depicts a cross-sectional view of the fluid adaptor 900 engaged with the coaxial connector of FIG. 10 using a threaded portion 930 of fluid adaptor 900 and the threaded portion 525 of the main nut 500. A tapered portion 925 of the fluid adaptor 900 seals against the conical portion 520 of the main nut 500. At this point, fluid may be injected to remove cable dielectric material 110 and inner conductor 105. Phantom lines around a front end 905 of the fluid adaptor 900 indicate a hydraulic fitting such as a quick disconnect or the like.

Figure 14:
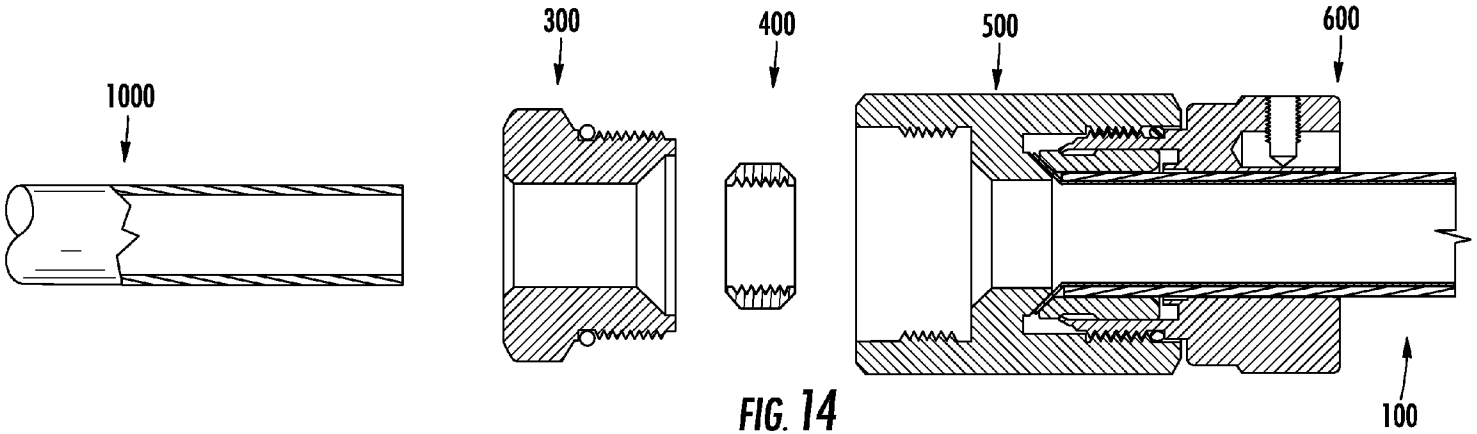
FIG. 14 schematically depicts a schematic cross-sectional view of a tubing, the packing nut and the packing introduced in preparation for engagement with the main nut, the back nut and installed coaxial cable, according to one or more embodiments shown and described herein.

FIG. 14 depicts a schematic cross-sectional view of a tubing 1000, the packing nut 300 and the packing sleeve 400 introduced in preparation for engagement with the main nut 500, the back nut 600 and installed coaxial cable 100. As shown in FIG. 14, the coaxial cable 100 dielectric material 110 and inner conductor 105 have been ejected from the coaxial cable 100.

Figure 15:
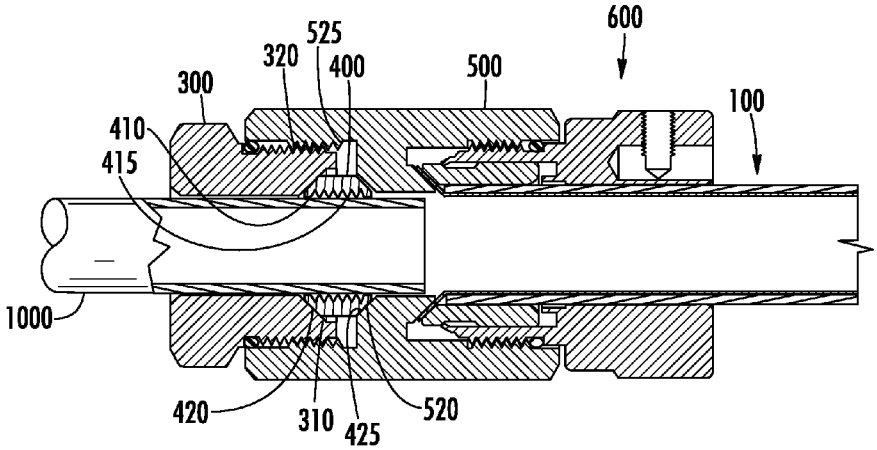
FIG. 15 schematically depicts a partial cross-sectional view of a completed feed-through assembly wherein the tubing has been inserted through a through-bore of the packing nut, an opening of the packing and the inside of the outer conductor, according to one or more embodiment shown and described herein.

FIG. 15 depicts a partial cross-sectional view of a completed feed-through assembly in which the tubing 1000 has been inserted though the through-bore 315 of the packing nut 300, an opening 410 of the packing sleeve 400 and the inside of the outer conductor 115. In one embodiment, for example, the tubing 100 may be constructed from a polymer or other plastic material. Advancing the packing nut 300 by engaging the threaded portion 320 of the packing nut 300 with the threaded portion 525 of the main nut 500 drives a conical portion 310 of the packing nut 300 against a tapered portion 420 of the packing sleeve 400. Likewise, a tapered portion 425 of the packing sleeve 400 is driven against the conical portion 520 of the main nut 500. A ramp-like action of the conical and tapered surfaces described drives an opening 410 of the packing sleeve 400 radially inwardly and causes grooves/ridges 415 of the packing sleeve 400 to engage or grip tubing 1000 and prevents the tubing 1000 from experiencing unwanted movement. The example illustration of a completed feed-through assembly in FIG. 15 is shown as not having a ground wire installed.

Figure 16:
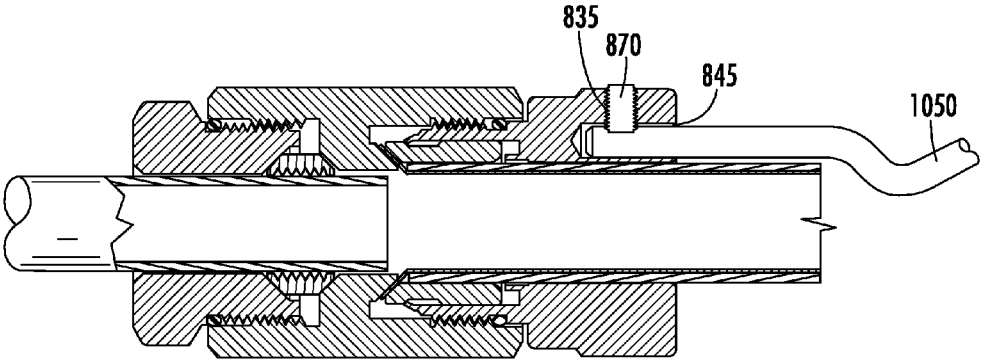
FIG. 16 schematically depicts a partial cross sectional view of a completed feed-through assembly of FIG. 15 having a ground wire installed in a bonding port of the back nut, according to one or more embodiments shown and described herein.

FIG. 16 is a partial cross sectional view of a completed feed-through assembly of FIG. 15 having a ground wire 1050 installed in a bonding port 845 of the back nut 800 and secured with a set screw 870 within the threaded hole 835.

Figure 17:
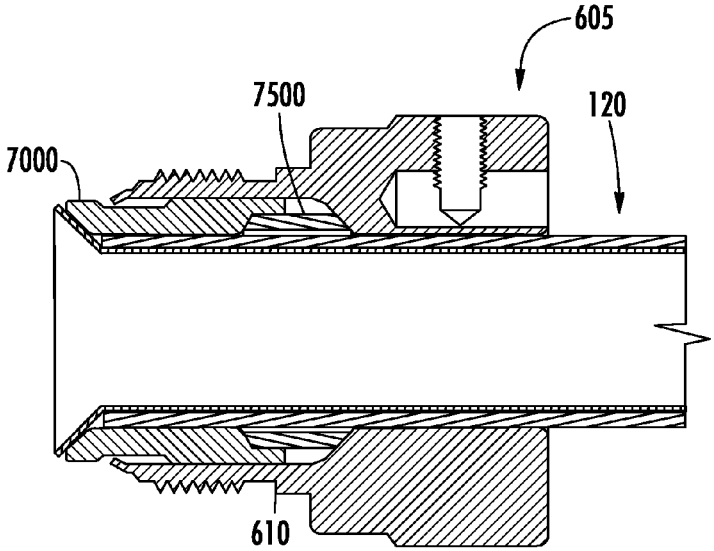
FIG. 17 schematically depicts a cross-sectional view of the sub-assembly in an uncompressed condition about a cable, according to one or more embodiments shown and described herein.

Attention will now be drawn to various example embodiments for feed-through connectors starting with FIG. 17. FIG. 17 depicts a cross-sectional view of a sub-assembly 605 in an uncompressed condition about a cable. The sub-assembly 605 comprises an actuator sleeve 7000, a ferrule 7500 and a back nut 610. In this embodiment, the ferrule 7500 is disposed within the sub-assembly 605 between tapered surfaces of the actuator sleeve 7000 and back nut 610 as shown in FIG. 17.

Figure 18A:
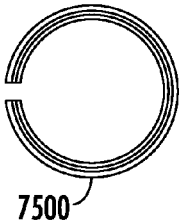
FIG. 18A schematically depicts an end view of the ferrule of FIG. 17, according to one or more embodiments shown and described herein.
Figure 18B:
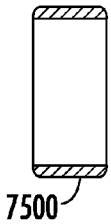
FIG. 18B schematically depicts a cross sectional view of ferrule of FIG. 17, according to one or more embodiments shown and described herein.

FIG. 18A is an end view of ferrule 7500 of FIG. 17. FIG. 18B is a cross sectional view of ferrule 7500 of FIG. 17. As shown in FIG. 18A, the ferrule comprise a generally circular, broken ring including an opening 7505. The opening 7505 of the ferrule 7500 allows for the ferrule to be compressed around a cable or tubing extending through an opening 7520 of the ferrule 7500 as opposing ends 7510 and 7515 are brought toward each other.

Figure 19:
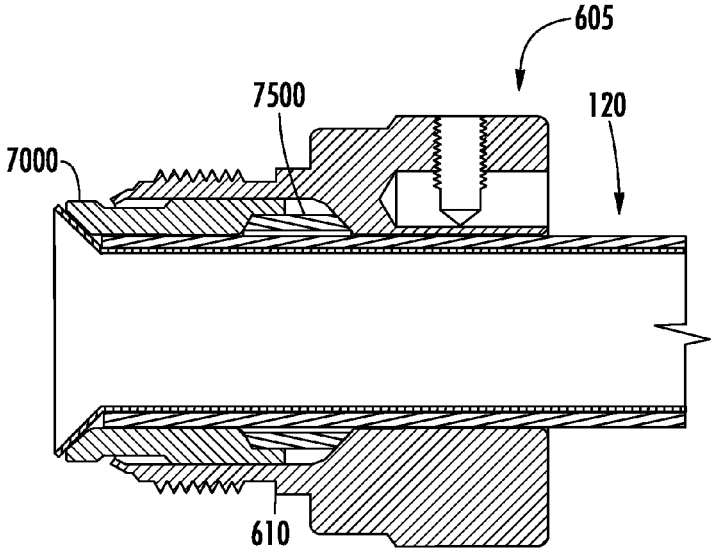
FIG. 19 schematically depicts a cross-sectional view of the sub-assembly of FIG. 17 in a compressed condition about a cable, according to one or more embodiments shown and described herein.

FIG. 19 depicts a cross-sectional view of the sub-assembly 605 of FIG. 17 in a compressed condition about a cable. In a manner similar to the functions described regarding FIG. 12, angled features of actuator sleeve 7000 and back nut 610 serve to compress ferrule 7500 radially inwardly to capture cable jacket 120.

Figure 20:
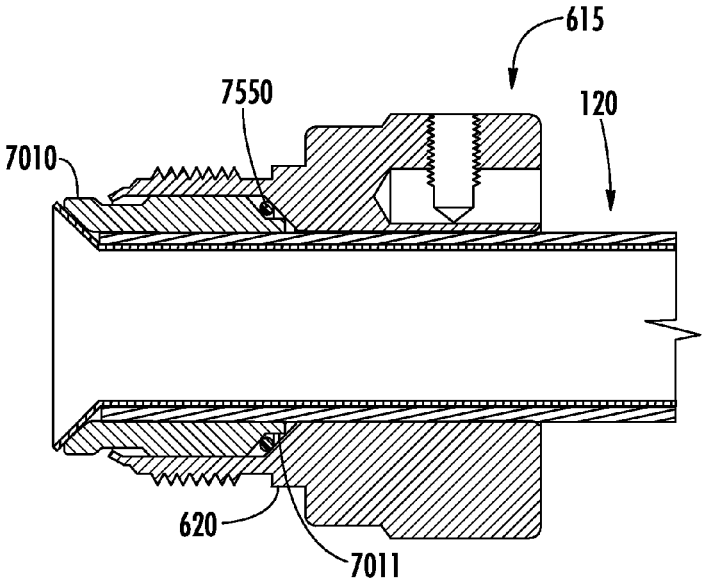
FIG. 20 schematically depicts a cross-sectional view of an alternative embodiment of a sub-assembly in an uncompressed condition about a cable, according to one or more embodiments shown and described herein.

FIG. 20 depicts a cross-sectional view of an alternative embodiment of a sub-assembly 615 in an uncompressed condition about a cable. The sub-assembly 615 comprises an actuator sleeve 7010 having a lip 7011, and an O-ring 7550. The sub-assembly 615, however, may be constructed without the O-ring and/or with another sealing device.

Figure 21A:
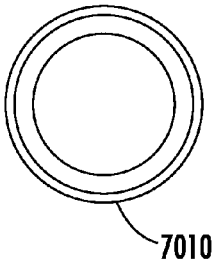
FIG. 21A depicts an end view of the actuator sleeve of FIG. 20, according to one or more embodiments shown and described herein.
Figure 21B:
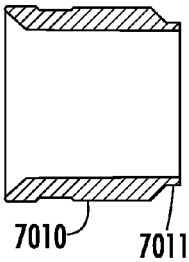
FIG. 21B schematically depicts a cross-sectional view of the actuator sleeve of FIG. 20, according to one or more embodiments shown and described herein.
Figure 22:
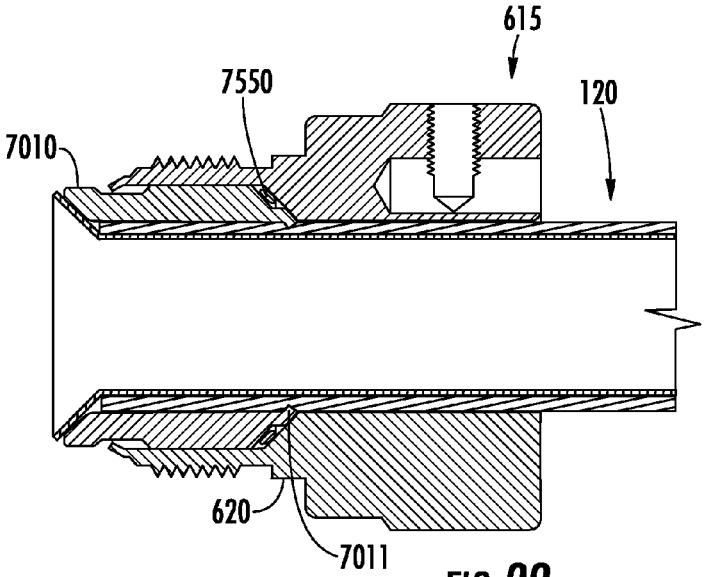
FIG. 22 schematically depicts a cross sectional view of the sub-assembly of FIG. 20 in a compressed condition about a cable, according to one or more embodiments shown and described herein.

FIG. 21A depicts an end view of actuator sleeve 7010 of FIG. 20. FIG. 21B depicts a cross sectional view of actuator sleeve 7010 of FIG. 20. FIG. 22 depicts a cross-sectional view of the sub-assembly 615 of FIG. 20 in a compressed condition about a cable. In a manner similar to the functions described regarding FIG. 12, angled features of actuator sleeve 7010 and back nut 620 serve to compress a lip 7011 of the actuator sleeve 7010 radially inwardly to capture cable jacket 120. Optional O-ring 7550 serves to buffer or protect lip 7011 during shipping and handling and may further serve as an additional moisture barrier.

Figure 23:
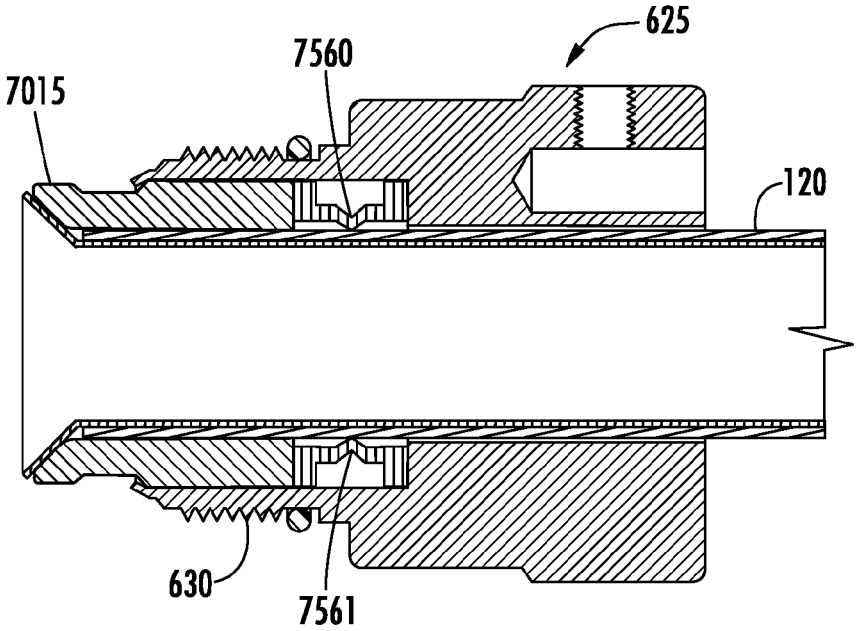
FIG. 23 schematically depicts a cross-sectional view of another embodiment of a sub-assembly in an uncompressed condition about a cable, according to one or more embodiments shown and described herein.
Figure 24A:
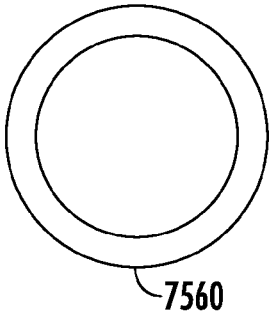
FIG. 24A schematically depicts an end view of the collapsible ring of FIG. 23, according to one or more embodiments shown and described herein.
Figure 24B:
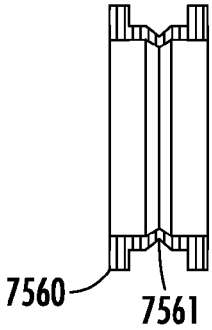
FIG. 24B schematically depicts a cross-sectional view of the collapsible ring of FIG. 23, according to one or more embodiments shown and described herein.

FIG. 23 depicts a cross sectional view of another embodiment of a sub assembly 625 in an uncompressed condition about a cable. The sub-assembly 625 comprises an actuator sleeve 7015 and a collapsible ring 7560. FIG. 24A depicts an end view of the collapsible ring 7560 of FIG. 23. FIG. 24B depicts a cross-sectional view of the collapsible ring 7560 of FIG. 23.

Figure 25:
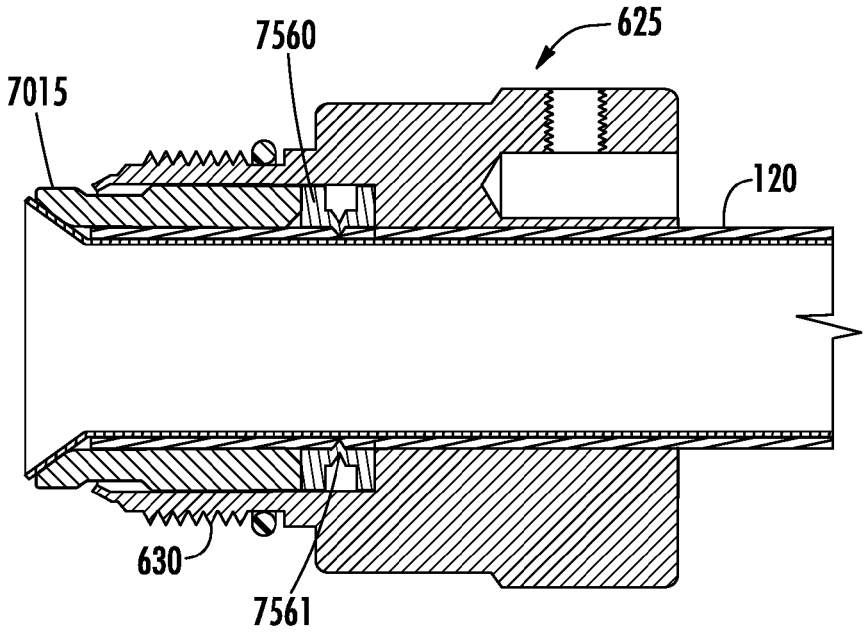
FIG. 25 schematically depicts a cross-sectional view of the sub-assembly of FIG. 23 in a compressed condition about a cable, according to one or more embodiments shown and described herein.

FIG. 25 depicts a cross-sectional view of the sub-assembly 625 of FIG. 23 in a compressed condition about a cable. In a manner somewhat similar to the connector described regarding FIG. 12, the actuator sleeve 7015 and the back nut 630 compress the collapsible ring 7560 in an axial manner driving shaped portion 7561 radially inwardly to capture cable jacket 120. Similar axial crushing/radial diameter reduction may be found in U.S. Pat. No. 5,525,076 by William Down, which is incorporated by reference in its entirety as if fully set forth herein.

Figure 26:
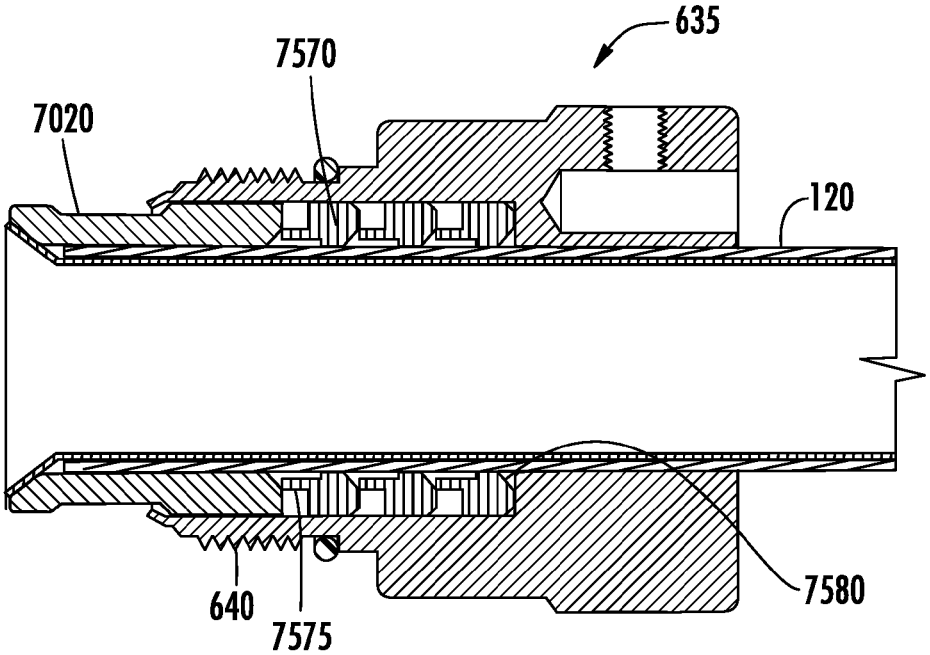
FIG. 26 schematically depicts a cross-sectional view of another embodiment of a sub-assembly in an uncompressed condition about a cable, according to one or more embodiments shown and described herein.
Figure 27A:
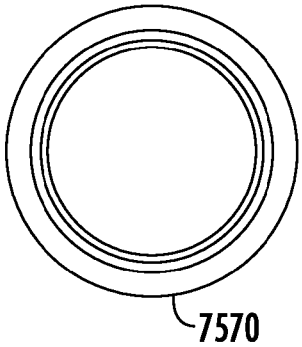
FIG. 27A schematically depicts an end view of the ring of FIG. 26, according to one or more embodiments shown and described herein.
Figure 27B:
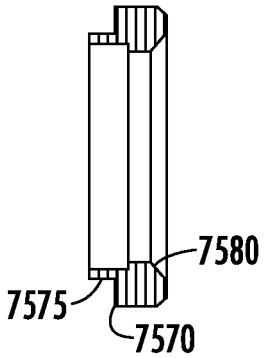
FIG. 27B is a cross-sectional view of the ring of FIG. 26, according to one or more embodiments shown and described herein.

FIG. 26 depicts a cross-sectional view of another embodiment of a sub-assembly in an uncompressed condition about a cable. The sub-assembly 635 in this embodiment comprises an actuator sleeve 7020 and a plurality rings 7570 having a lip 7575 and a tapered portion 7580. FIG. 27A depicts an end view of the ring 7570 of FIG. 26. FIG. 27B depicts a cross-sectional view of the ring 7570 of FIG. 26.

Figure 28:
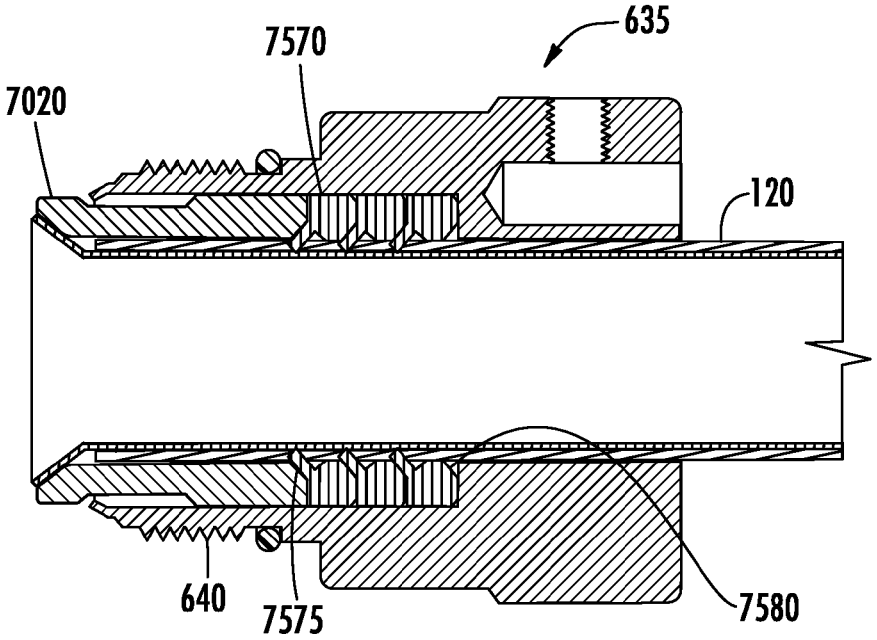
FIG. 28 schematically depicts a cross-sectional view of the sub-assembly shown in FIG. 26 in a compressed condition about a cable, according to one or more embodiments shown and described herein.

FIG. 28 depicts a cross-sectional view of the sub-assembly 635 shown in FIG. 26 in a compressed condition about a cable. In a manner similar to the functions described regarding FIG. 12, the actuator sleeve 7020 and the back nut 640 serve to compress at least one ring 7570 driving lip(s) 7575 radially inwardly to capture a cable jacket 120 as previously described. In this embodiment, the ring(s) 7570 each have a tapered portion 7580 to co-act with the lip(s) 7575 of the successive ring(s) 7570. It should be understood that a single ring 7570 or a plurality of rings 7570 could be used.

Figure 29:
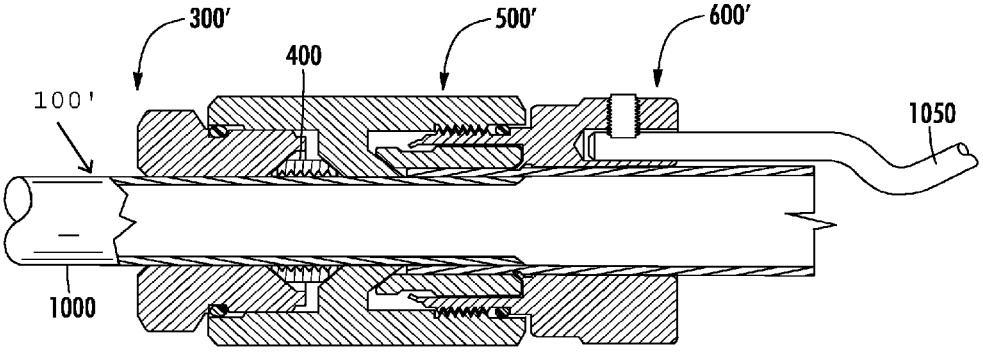
FIG. 29 schematically depicts a partial cross-sectional view of an alternate embodiment of a completed feed-through connector assembly, according to one or more embodiments shown and described herein.

FIG. 29 depicts a partial cross-sectional view of an alternate embodiment of a completed feed-through connector assembly at least partially comprising polymer tubing 1000, packing nut 300', packing sleeve 400, main nut 500', and sub assembly 600'. This embodiment functions like that described in FIG. 12 through FIG. 16 with the exception that threaded portions on the packing nut 300', the main nut 500' and the sub-assembly 600' are omitted. In this embodiment, the packing nut 300', the main nut 500' and the sub-assembly 600' are axially driven together using a compression tool (not shown) and are retained by means of a press fit. This press-fit approach may also be applied to alternate embodiments previously described. Further shown in FIG. 29 is a conduit 100' secured by the connector assembly.

Figure 30:
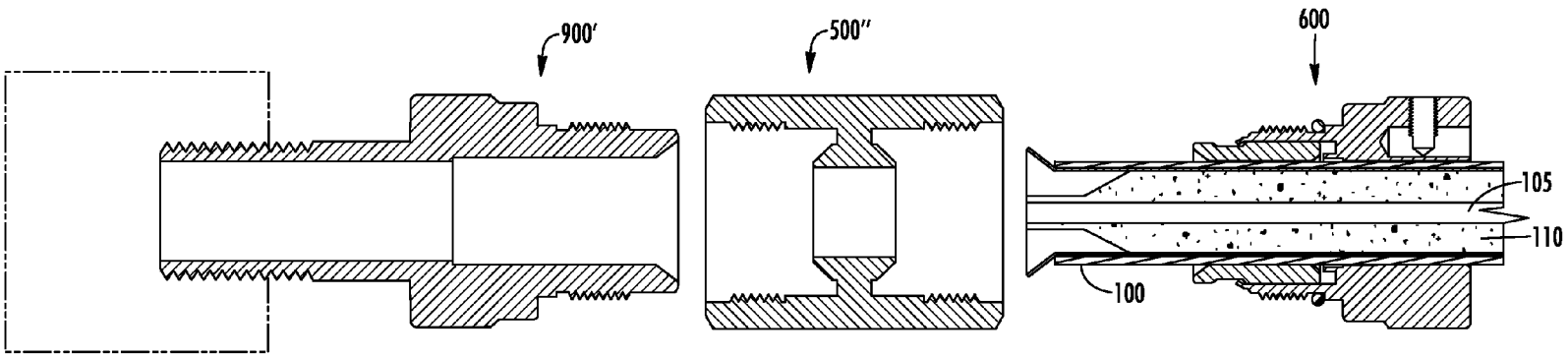
FIG. 30 schematically depicts a cross-sectional view showing a sub-assembly having a coaxial cable inserted therethrough, according to one or more embodiments shown and described herein.

FIG. 30 depicts a cross-sectional view showing a sub-assembly 600 having a coaxial cable 100 inserted therethrough and the cable 100 has been prepared and flared. A splice main nut 500" is introduced as is a fluid adaptor 900' in preparation for a step of a process similar to that described for FIG. 11 through FIG. 13. In FIG. 30 the cable center conductor 105 and dielectric material 110 are still in place.

Figure 31:
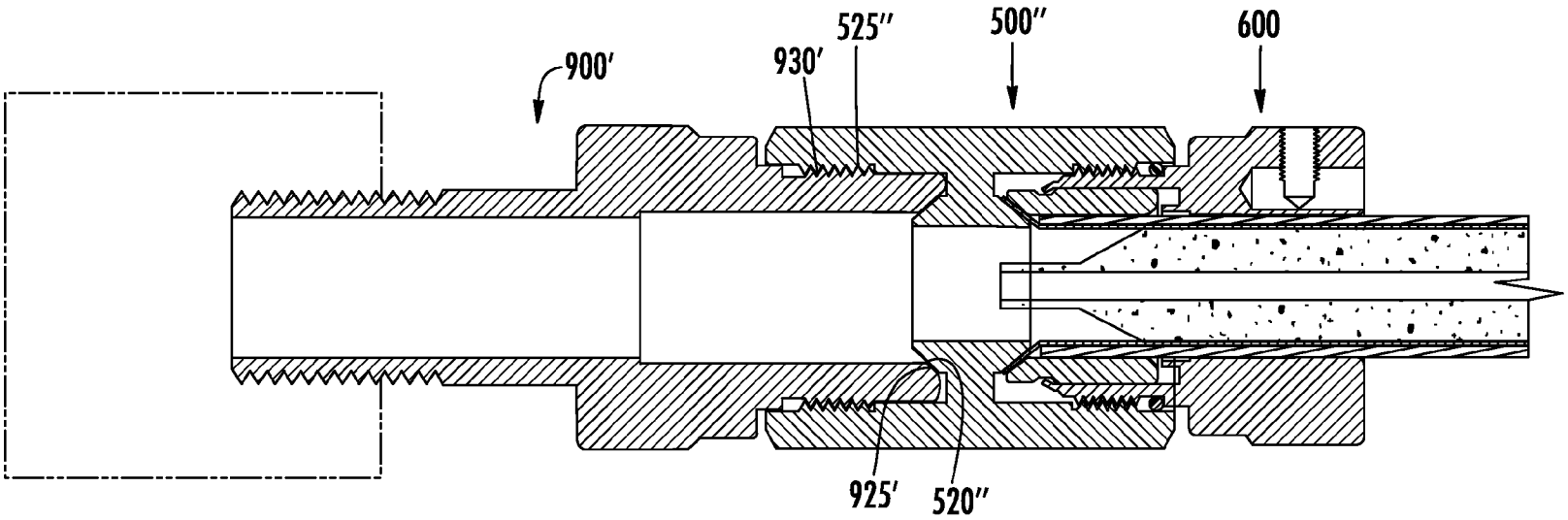
FIG. 31 schematically depicts a cross-sectional view fluid adaptor engaged with the connection system of FIG. 30 by means of threaded portions of fluid adaptor and threaded portion of splice main nut, according to one or more embodiments shown and described herein.

FIG. 31 depicts a cross-sectional view fluid adaptor 900' engaged with the connection system of FIG. 30 by means of threaded portions 930' of fluid adaptor 900' and threaded portion 525" of splice main nut 500". Tapered portion 925' of fluid adaptor 900' seals against conical portion 520" of splice main nut 500". At this point, fluid may be injected to remove cable dielectric material 110 and inner conductor 105. Phantom lines around front end 905' of fluid adaptor 900 indicate a hydraulic fitting such as a quick disconnect or the like.

Figure 32:
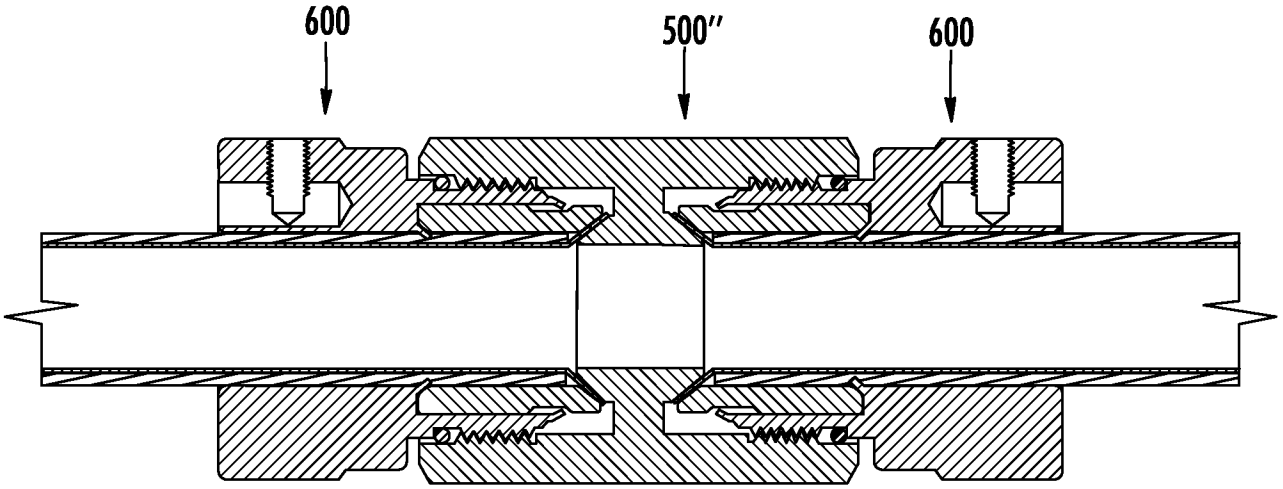
FIG. 32 schematically depicts a partial cross-sectional view of a completed splice assembly comprising two sub-assemblies 600 and a splice main nut, according to one or more embodiments shown and described herein.

FIG. 32 depicts a partial cross-sectional view of a completed splice assembly comprising two sub-assemblies 600 and a splice main nut 500" in which the sub-assemblies 600 interact with the splice main nut 500" and the cable 100 in a similar manner as described with respect to FIG. 13.

Figure 33:
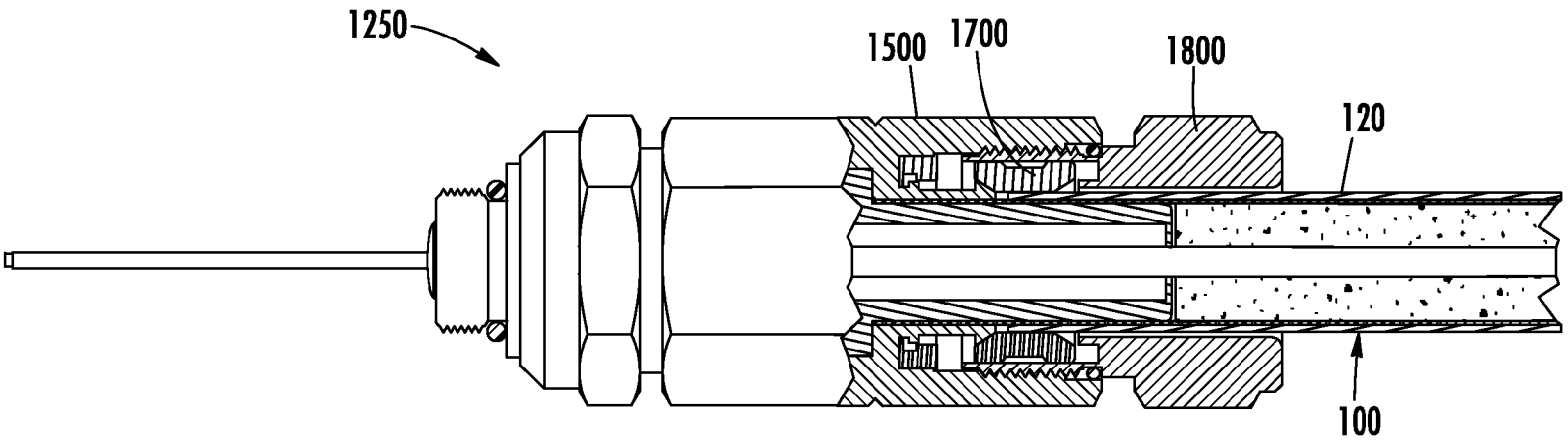
FIG. 33 schematically depicts a partial cross-sectional view of a three piece hardline coaxial pin type connector with having a jacket retention mechanism as described above with respect to FIGS. 4-10 in which a back coupler sleeve/nut is a not fully tightened condition, according to one or more embodiments shown and described herein.

FIG. 33 depicts a partial cross-sectional view of a three piece hardline coaxial pin type connector 1250 with having a jacket retention mechanism as described above with respect to FIGS. 4-10 in which a back coupler sleeve/nut is a not fully tightened condition. In this embodiment, the connector 1250 includes a front/main coupler sleeve/nut 1500, an actuator sleeve 1700 and a back coupler sleeve/nut 1800 similar to the components described with reference to FIGS. 4-10.

Figure 34:
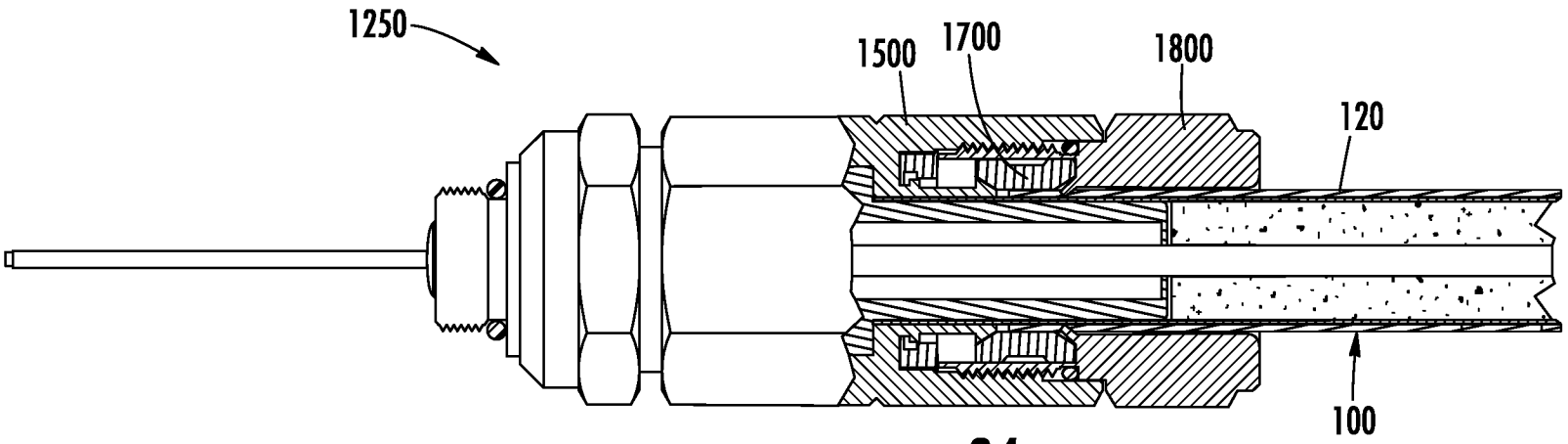
FIG. 34 schematically depicts a partial cross-sectional view of the three piece hardline coaxial pin type connector shown in FIG. 33 with the jacket retention mechanism having a back nut in a tightened condition, according to one or more embodiments shown and described herein.

FIG. 34 depicts a partial cross-sectional view of the three piece hardline coaxial pin type connector 1250 shown in FIG. 33 with the jacket retention mechanism having a back nut in a tightened condition.

Figure 35:
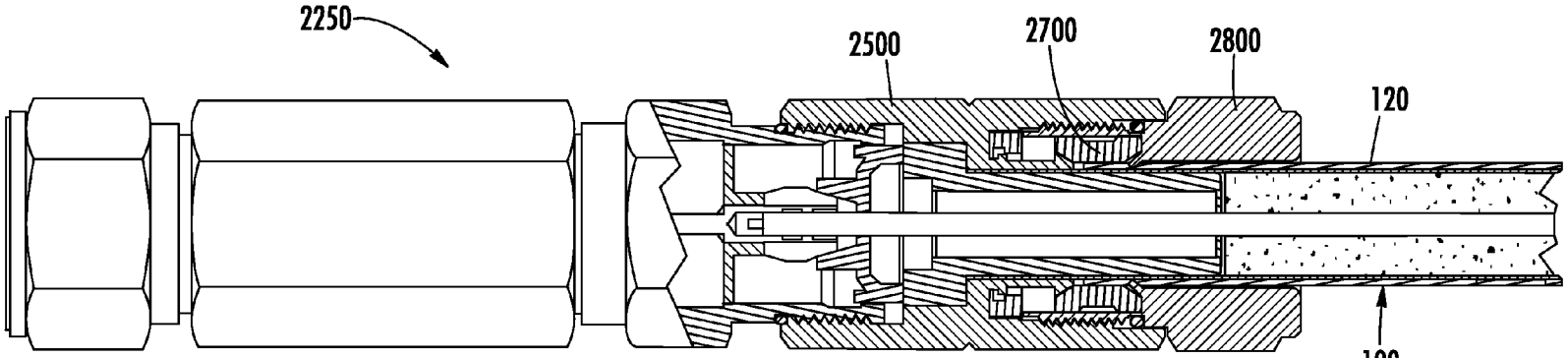
FIG. 35 schematically depicts a partial cross-sectional view of a three piece hardline coaxial splice type connector with a jacket retention mechanism as described above with respect to FIGS. 4-10 in which a back coupler sleeve/nut is in a tightened condition, according to one or more embodiments shown and described herein.

FIG. 35 depicts a partial cross-sectional view of a three piece hardline coaxial splice type connector 2250 with a jacket retention mechanism as described above with respect to FIGS. 4-10 in which a back coupler sleeve/nut is in a tightened condition. The connector 2250 includes a front/main coupler sleeve/nut 2500, an actuator sleeve 2700 and a back coupler sleeve/nut 2800 similar to the components described with reference to FIGS. 4-10.

It should now be understood that embodiments described herein are directed to connectors and methods for securing an outer layer of a cable or conduit within a connector.

For the purposes of describing and defining the subject matter of the disclosure it is noted that the term "substantially" is utilized herein to represent the inherent degree of uncertainty that may be attributed to any quantitative comparison, value, measurement, or other representation.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the embodiments disclosed herein should be construed to include everything within the scope of the appended claims and their equivalents.

What is claimed is:

1. A connector for securing an outer surface of a cable or conduit, the connector comprising:

a back coupler sleeve comprising at least one inner surface defining a back coupler sleeve opening extending through the back coupler sleeve, an outer surface and an at least partially annular protrusion formed along the inner surface within the back coupler sleeve opening;

an actuator sleeve comprising an outer surface and an inner surface, the inner surface defining an actuator sleeve opening extending through the actuator and adapted to receive the cable, the inner surface including a tapered portion adapted to at least partially receive the at least partially annular protrusion of the back coupler sleeve within the actuator sleeve opening, the actuator sleeve inserted into the back coupler sleeve opening of the back coupler sleeve and disposed adjacent to the at least partially annular protrusion of the back coupler sleeve; and a front coupler sleeve comprising an inner surface disposed about at least a portion of the outer surface of the back coupler sleeve and at least a portion of the outer surface of the actuator sleeve and adapted to engage the outer surface of the back coupler sleeve, wherein engagement of inner surface of the front coupler sleeve and the outer surface of the back coupler sleeve is adapted to displace the at least partially annular protrusion of the back coupler sleeve radially inwardly to secure the outer surface of the cable or conduit.

2. The connector of claim 1 wherein the cable connector is adapted to secure the outer surface of at least one of a coaxial cable, a cored coaxial cable and a tube adapted to provide a conduit for receiving one or more cables within an opening of the tube.

3. The connector of claim 1 wherein the front coupler sleeve comprises a front nut including a front coupler sleeve threaded portion disposed along the front coupler sleeve inner surface.

4. The connector of claim 3 wherein the back coupler sleeve comprises a back coupler sleeve threaded portion disposed along the back coupler sleeve outer surface and adapted to engage the front coupler sleeve threaded portion to axially displace the back coupler sleeve relative to the front coupler sleeve.

5. The connector of claim 1 wherein the inner surface of the front coupler sleeve defines a front opening and a back opening adapted to receive the back coupler sleeve, the front opening disposed on an opposing end from the back opening.

6. The connector of claim 5 further comprising a packing coupler sleeve and packing sleeve, the packing coupler sleeve comprising an outer surface adapted to engage with the inner surface of the front coupler sleeve defining the front opening of the front coupler sleeve and the packing sleeve adapted to be retained between the packing coupler sleeve and the front coupler sleeve.

7. The connector of claim 6 wherein the outer surface of the packing coupler sleeve comprises a packing coupler sleeve threaded portion adapted for threadably engaging a second threaded portion of the front coupler sleeve disposed on an inner surface of the front opening of the front coupler sleeve.

8. The connector of claim 6 wherein a through-bore connects the front opening and the back opening of the front coupler sleeve.

9. The connector of claim 8 wherein the packing sleeve comprises a tapered portion adapted to be driven against a conical portion of the through-bore of the front coupler sleeve.

10. The connector of claim 8 wherein the front opening, back opening and through-bore of the front coupler sleeve form a continuous opening through the front coupler sleeve.

11. The connector of claim 10 wherein the continuous opening is adapted to receive a tubing providing a feed-through assembly extending through the connector.

12. The connector of claim 1 wherein the back coupler sleeve comprises an axially extending port disposed extending from a back end of the back coupler sleeve.

13. The connector of claim 12 wherein a grounding wire is coupled to the back coupler sleeve within the axially extending port.

14. The connector of claim 1 wherein the actuator sleeve comprises a ferrule.

15. The connector of claim 1 wherein an outer surface of the actuator sleeve forms a recess adapted to engage a lip of the back coupler sleeve to restrict axial movement of the actuator sleeve with respect to the back coupler sleeve.

16. The connector of claim 1 wherein a collapsible ring is disposed between the actuator sleeve and the back coupler sleeve.

17. The connector of claim 1 wherein a plurality of rings are disposed between the actuator sleeve and the back coupler sleeve.

18. The connector of claim 1 wherein the at least partially annular protrusion comprises an annular ring extending from the inner surface of the back coupler sleeve.

* * * * *